US009422726B2

(12) United States Patent
Walston

(10) Patent No.: US 9,422,726 B2
(45) Date of Patent: Aug. 23, 2016

(54) STAIR SYSTEM

(75) Inventor: Richard D. Walston, Guilford, CT (US)

(73) Assignee: BECKM, LLC, Guilford, CT (US)

( * ) Notice: Subject to any disclaimer, the term of this patent is extended or adjusted under 35 U.S.C. 154(b) by 0 days.

(21) Appl. No.: 13/881,947

(22) PCT Filed: Oct. 27, 2011

(86) PCT No.: PCT/US2011/058020

§ 371 (c)(1),
(2), (4) Date: Apr. 26, 2013

(87) PCT Pub. No.: WO2012/058389

PCT Pub. Date: May 3, 2012

(65) Prior Publication Data

US 2013/0239496 A1 Sep. 19, 2013

Related U.S. Application Data

(60) Provisional application No. 61/430,700, filed on Jan. 7, 2011, provisional application No. 61/407,336, filed on Oct. 27, 2010.

(51) Int. Cl.

| | |
|---|---|
| ***E04F 11/06*** | (2006.01) |
| ***E04F 11/025*** | (2006.01) |
| ***E04F 11/104*** | (2006.01) |
| ***E04F 11/112*** | (2006.01) |
| ***E04F 11/18*** | (2006.01) |

(52) U.S. Cl.

CPC ..... *E04F 11/068* (2013.01); *E04F 11/025* (2013.01); *E04F 11/1041* (2013.01); *E04F 11/112* (2013.01); *E04F 11/1817* (2013.01)

(58) Field of Classification Search

CPC ..... E04F 11/025; E04F 11/068; E04F 11/104; E04F 11/1041; E04F 11/112

USPC ..... 52/182, 183, 184, 185, 191, 188; 182/1, 182/97, 91, 207

See application file for complete search history.

(56) References Cited

U.S. PATENT DOCUMENTS

| | | | | |
|---|---|---|---|---|
| 550,370 | A | 11/1895 | Hartzell | |
| 1,075,156 | A | 10/1913 | Nesdall | |
| 3,021,928 | A * | 2/1962 | Blair | 52/191 |
| 3,626,438 | A * | 12/1971 | Cornell | 52/183 |
| 3,713,511 | A * | 1/1973 | Hinkle | 182/95 |
| 3,765,137 | A * | 10/1973 | Loix | 52/182 |
| 3,789,556 | A | 2/1974 | Skinner | |

(Continued)

FOREIGN PATENT DOCUMENTS

KR 20100055605 5/2010

OTHER PUBLICATIONS

International Search Report and Written Opinion for PCT/2011/058020, dated May 2, 2012.

*Primary Examiner* — Adriana Figueroa
*Assistant Examiner* — Jessie Fonseca
(74) *Attorney, Agent, or Firm* — Bachman & LaPointe, P.C.

(57) ABSTRACT

A stair system (20; 300) comprises: a first length-adjustable stringer (40A; 308A); a second length-adjustable stringer (40B; 308B); and a plurality of tread assemblies (148; 350) installable to the first and second stringers. The system further includes at least one handrail (268; 302A, 302B). A plurality of balusters (280A, 280B; 360, 362) are attached or attachable to the tread assemblies and handrail. The tread assemblies each have an adjustable tread pitch.

20 Claims, 17 Drawing Sheets

(56) References Cited

U.S. PATENT DOCUMENTS

| | | | | | |
|---|---|---|---|---|---|
| 3,871,479 | A | * | 3/1975 | Pelto | 182/86 |
| 3,885,365 | A | * | 5/1975 | Cox | 52/183 |
| 4,015,687 | A | | 4/1977 | Dean | |
| 4,079,815 | A | * | 3/1978 | Cormier | 182/195 |
| 4,106,591 | A | * | 8/1978 | Cohen et al. | 182/93 |
| 4,406,347 | A | | 9/1983 | Stathopoulos | |
| 4,422,270 | A | * | 12/1983 | Lapointe et al. | 52/182 |
| 4,457,398 | A | * | 7/1984 | Loix | 182/151 |
| 4,583,334 | A | | 4/1986 | Hubbard | |
| 4,586,585 | A | | 5/1986 | Zaner | |
| 4,598,510 | A | | 7/1986 | Wagner, III | |
| 4,759,162 | A | | 7/1988 | Wyse | |
| 4,875,315 | A | * | 10/1989 | Champagne | 52/189 |
| 4,959,935 | A | | 10/1990 | Stob | |
| 5,131,197 | A | * | 7/1992 | Varga | 52/183 |
| 5,957,146 | A | * | 9/1999 | Corey | 135/65 |
| 6,125,598 | A | * | 10/2000 | Lanphier | 52/182 |
| 6,256,946 | B1 | * | 7/2001 | Kennedy et al. | 52/183 |
| 6,345,475 | B1 | * | 2/2002 | Flory | 52/184 |
| 6,397,529 | B1 | | 6/2002 | Grenier | |
| 6,516,574 | B1 | | 2/2003 | Couture | |
| 6,574,923 | B1 | * | 6/2003 | Johnsson et al. | 52/8 |
| 6,868,944 | B2 | * | 3/2005 | Truckner et al. | 182/228.1 |
| 7,631,463 | B2 | | 12/2009 | Greenlee et al. | |
| 8,091,294 | B2 | * | 1/2012 | Whalen | 52/183 |
| 2008/0022611 | A1 | * | 1/2008 | Bird | 52/182 |
| 2011/0239556 | A1 | * | 10/2011 | Burford et al. | 52/183 |

* cited by examiner

STAIR SYSTEM

CROSS-REFERENCE TO RELATED APPLICATIONS

Benefit is claimed of U.S. patent application Ser. No. 61/407,336, filed Oct. 27, 2010, and entitled "Stair System" and U.S. patent application Ser. No. 61/430,700, filed Jan. 7, 2011, and entitled "Stair System", the disclosures of which are incorporated by reference herein in their entirety as if set forth at length.

BACKGROUND OF THE INVENTION

The invention relates to construction. More particularly, the invention relates to staircases.

In many construction situations, temporary staircases are needed. For example, architectural plans may call for an ornate staircase which might be damaged during construction. Also, plans may call for a staircase fabricated off-site which may not be available in early phases of construction. In such situations, it is common for builders to fabricate a temporary staircase. Because the dimensions of stringers will depend upon the height difference between floors, they may not be easily re-used if the height of the next location differs. Additionally, increasing safety requirements increase the complexity and costs of temporary staircases.

SUMMARY OF THE INVENTION

A stair system comprises: a first length-adjustable stringer; a second length-adjustable stringer; and a plurality of tread assemblies installable to the first and second stringers. Each tread assembly has an adjustable pitch tread.

In various implementations, there may be at least one handrail and a plurality of balusters attached or attachable to the tread assemblies and handrail. The stringers may be telescoping stringers. Each stringer may have a longitudinal array of first engagement features. Each tread assembly may have one or more left engagement features and one or more right engagement features respectively mountable to the first engagement features of a respective left said stringer and a respective right said stringer.

In various implementations, there may be means for adjusting a vertical registration of the first and second stringers with the upper floor (e.g., registration with a top plate assembly).

Another aspect of the disclosure involves a tread assembly for mounting to a first stringer and a second stringer. The tread assembly comprises a tread. There are means for removably and reinstallably mounting the tread to the first and second stringers. There are means for adjusting a pitch (pitch angle) of the tread.

The means for adjusting the pitch of the tread may effectively adjust a rise of the tread. The means for removably and reinstallably mounting may include respective left and right engagement features. The left and right engagement features may comprise downwardly-open channels for receiving the stringers. The engagement features may comprise keying projections for mating with holes on the stringers. A riser may be rigidly connected (e.g., via welding) to the channels.

Another aspect of the disclosure involves a stair system for spanning between a lower floor and an upper floor. The system includes first and second length adjustable stringers. A plurality of tread assemblies are installable to the first and second stringers. There is means for adjusting a vertical registration of the first and second stringers with the upper floor.

Other aspects of the disclosure involve methods for using such systems and components. The system may be installed between a lower floor and an upper floor of a building. The installation may comprise determining a length setting for the stringers based upon a height of the upper floor above the lower floor. This determining may be done by first determining a tread count based upon the height. The tread count or other determined length may be used to adjust the stringers to the length setting. The stringers may be attached to the upper floor and the lower floor. Tread assemblies may be attached to the stringers. In various implementations, at least some of the tread assemblies may be installed after the stringers are attached to at least one of the upper floor and lower floor. The attaching/mounting of at least some of the tread assemblies may include lowering the tread assemblies onto the stringers so that upper portions of the stringers (e.g., of the stringer cross-sections) are received in respective channels of the tread assemblies. The tread assemblies may be longitudinally shifted so that the features shift to a locked condition wherein direct translatory removal of the tread assembly is prevented or otherwise resisted. A pitch (pitch angle) of at least some of the tread assemblies may be adjusted. The pitch adjustment may comprise relative rotation of respective left and right jack screws and nuts (e.g., rotating a nut relative to a rotationally captured jack screw). A vertical registry of the stringers with the upper floor may be adjusted.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

The drawings show exemplary stair systems with exemplary dimensions corresponding to an exemplary US installation situation in view of exemplary US code requirements.

Like reference numbers and designations in the various drawings indicate like elements.

DETAILED DESCRIPTION

Figure 1:
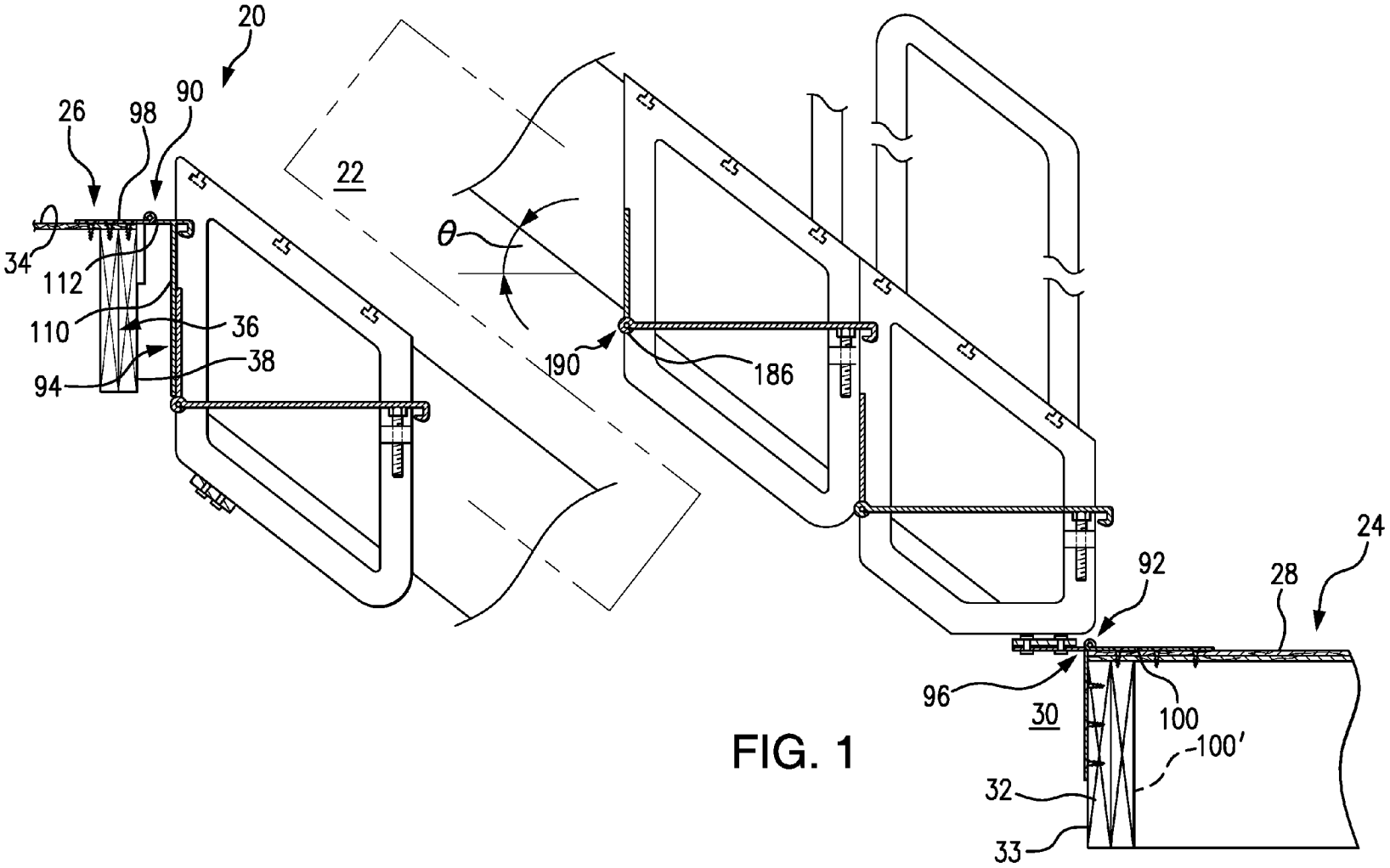
FIG. 1 is a cutaway partial side view of upper and lower portions of a staircase.
Figure 2:
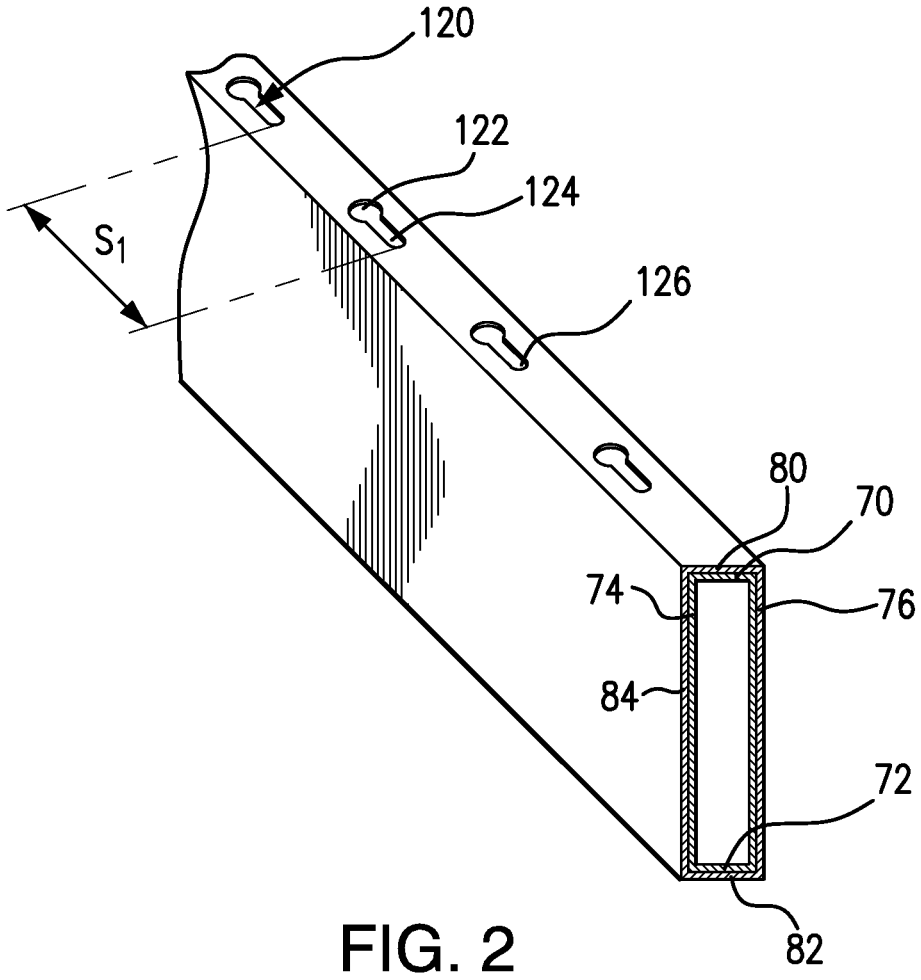
FIG. 2 is a cutaway view of a stringer assembly of the staircase of FIG. 1.
Figure 3:
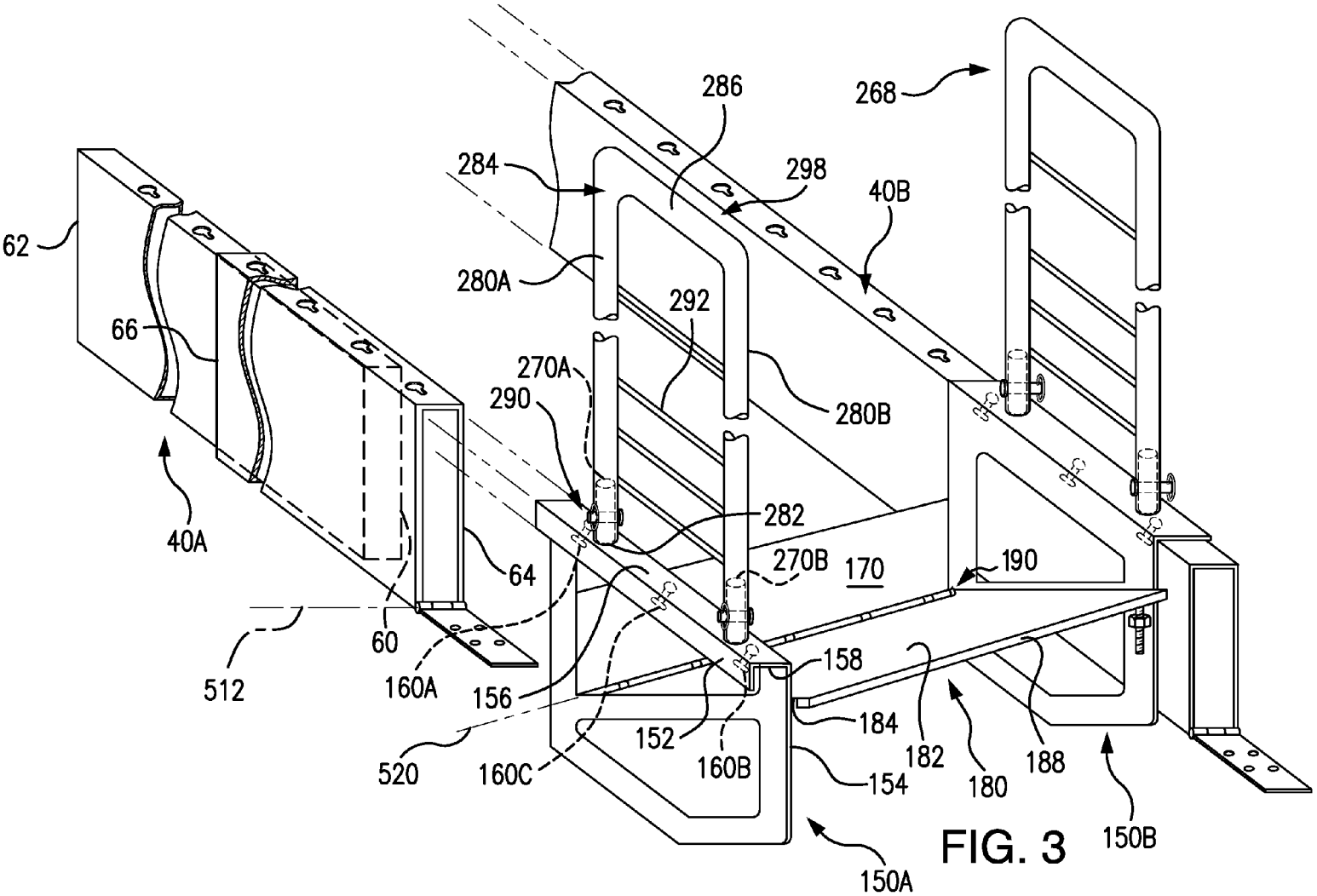
FIG. 3 is a partially exploded view of a tread assembly on the staircase of FIG. 1.
Figure 4:
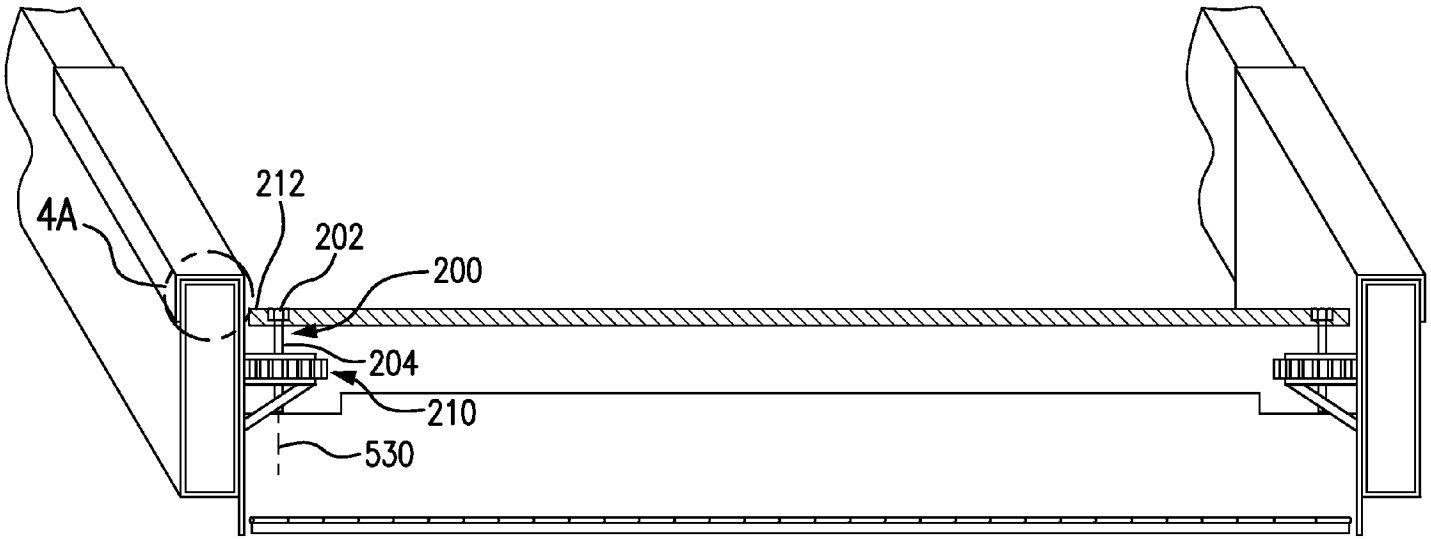
FIG. 4 is a cutaway view of a tread assembly on the staircase of FIG. 1.
Figure 4A:
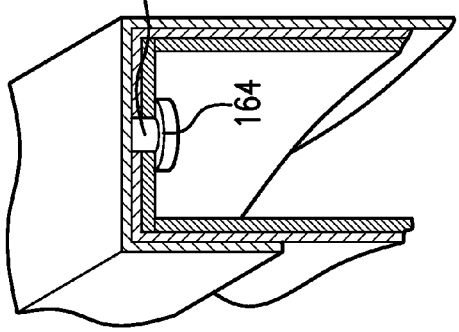
FIG. 4A is an enlarged view, designated by numeral 4A in FIG. 4, of a tread hanger region of FIG. 4.

A temporary stair system 20 is used in a building 22 having a lower floor 24 and an upper floor 26. The lower floor has a floor surface 28 and may have an opening 30 at a header 32 (e.g., likely the case if there is a series of stairways one above the other). The header has a surface/face 33. Similarly, the upper floor has a floor surface 34 and has a header 36 having a header surface/face 38. The exemplary stairway has a first length-adjustable stringer 40A and a second length-adjustable stringer 40B. The exemplary stringers are identical to each other. The exemplary stringers are mounted off-horizontal by an angle θ. When viewed from the perspective of a user ascending the staircase, the first stringer is a left stringer and the second stringer is a right stringer. The exemplary stringers are extensible/contractible. Exemplary extensibility/contractibility is via telescoping. Exemplary telescoping is via a single inner member within a single outer member. In exemplary implementation, the outer member is the lower member whereas the inner member is the upper member. The upper member extends from a lower end 60 to an upper end 62. Similarly, the lower member extends from a lower end 64 to an upper end 66. Exemplary upper and lower members have an essentially rectangular tubular cross section. The upper member cross-section defines upper 70, lower 72, left 74, and right 76, sides. Similarly, the lower member cross-section defines upper 80, lower 82, left 84, and right 86, sides.

At its upper end, the upper member includes means for mounting to the upper floor. Similarly, at its lower end, the lower member includes means for mounting to the lower floor. Both exemplary means are hinges 90 and 92, respectively. The hinges have first portions 94, 96 secured to the associated member (e.g., via welding) and second portions 98, 100 hinged thereto for rotation about respective axes 510, 512. The exemplary upper hinge second portion will normally be secured to the upper floor along the upper surface thereof. Exemplary securing is by fasteners such as screws. Alternatively, however, the upper hinge second portion may be screwed against the face of the upper floor header.

To cover any gap between the uppermost riser and the upper floor, the exemplary system further includes a tread-like cap 106 which mounts to the floor surface of the upper floor and extends over the uppermost riser to form an uppermost nosing. The exemplary cap may be formed of the same or similar profile to the treads (e.g., formed of the same alloy extrusion). The cap may have screw holes for screwing into the upper floor. In the exemplary embodiment, the stringer upper hinges have underside rabbets 108 into which edge portions of the cap may be slid after installation of the uppermost tread assembly. Thereafter, the cap may be screwed down.

Exemplary upper hinges have axes offset away from the upper member extrusion. This allows for the change in pitch angle while avoiding bottoming against the header. The exemplary offset is provided by having the proximal/lower plate (portion) 98 of the hinge bent with a first portion 110 secured (e.g., welded) to the extrusion and an offsetting portion 112 extending to the axis. The offsetting portion is essentially horizontal when installed.

Similarly, the lower member hinge second portion may be screwed to the surface of the lower floor or to the exposed surface of the lower floor header (the latter position being shown as 100'). The upper sides/walls 70, 80 of the upper and lower members have a linear array of engagement features 120 for mating with the tread assemblies. Exemplary features 120 are keyholes having a relatively wide upper portion 122 and a relatively narrow lower portion 124 extending from the upper portion to an end 126. An exemplary keyhole spacing is shown as $S_1$.

Each stringer may similarly include means for locking the stringer at a series of specific lengths. An exemplary means comprises a linear array of holes 130 in the lower side/wall of the inner member which may be mated to a complementary engagement feature of the outer member. An exemplary complementary feature comprises a spring-loaded pin 132. The exemplary holes 130 have a central enlarged area and a pair of diametrically opposite legs extending therefrom. The central area is complementary to a shaft of the pin. The pin further includes a pair of diametrically protruding arms. The arms may be inserted through the arms of the hole and the pin then rotated to lock the pin in place. The pin passes partially through a hole (not shown) in the outer member. Other pin arrangements are possible. An exemplary spacing of these lower wall features is $S_2$. An exemplary spacing $S_2$ is the same as the spacing S of the installed tread assemblies 148. This combined with the particular registration of the array of features may insure that an integral number of tread assemblies will exactly fit along the stringers at each possible length of the stringers. The upper features may, more easily, be formed otherwise (e.g., as an array of pairs of longitudinally spaced-apart features (e.g., with a pair-to-pair spacing the same as $S_2$)) or the like.

The stringer may bear indicia indicating a particular state of extension. For example, the inner member may bear an array of marks which correspond to the nominal floor-to-floor height at the target nominal angle θ. An exemplary specific nominal θ is associated with a 7.5 inch rise and 10.0 inch run (e.g., 37 degrees) and an exemplary range for nominal θ would be associated with a rise of 6.5-8.25 inch (code range for rise) with a 10 inch run. An exemplary adjustment range might be at least that large. Each marking could, alternatively, identify a range of heights associated with such marking Alternatively, the user could be provided with a chart indicating what length setting is associated with what range of floor-to-floor height.

Each exemplary tread assembly 148 comprises a first side portion 150A for engaging the first stringer and a second side portion 150B for engaging the second stringer. The exemplary side portions are formed as downwardly-open right channels each having an outboard wall 152, an inboard wall 154, and an upper base wall or web 156. Depending from the channel inboard surface 158 along the base/web 156, each exemplary side portion has engagement features complementary to the engagement features of the stringer. Each exemplary engagement feature 160 comprises a pair of upper and lower projections 160A, 160B and an intermediate projection 160C. Each exemplary projection has a shaft 162 depending from an upper end at the web to a lower end. At the lower end, the projection has a head or protuberance 164. An exemplary head is formed as a flat feature. An exemplary flat feature is circular and slightly smaller than a similarly circular upper portion of the stringer engagement features. This allows the tread assembly to be installed by a downward (or particularly normal to the stringer longitudinal direction) insertion with the head 164 passing through the keyhole upper portion 122 followed by a downward longitudinal translation so that the shaft 162 passes into the keyhole lower portion 124 with the underside of the head becoming captured by the periphery of the keyhole. With the shaft abutting the lower end 126 of the keyhole, further downward longitudinal movement is prevented. The capturing prevents movement normal thereto. The exemplary tread assembly 148 comprises a riser 170 extending transversely between the two side portions and rigidly connected thereto (e.g., such as via welding).

The exemplary tread assembly also includes a tread 180 having an upper surface 182, a lower surface 184, a proximal end 186, a distal end 188, and left and right edges 189A and 189B. Near the proximal end, the exemplary tread is mounted relative to the side portions and riser via a hinge 190. An exemplary hinge 190 has a transverse pivot axis 520. The exemplary hinge may have respective portions secured to the riser and tread (e.g., via welding) or unitarily formed therewithin.

The exemplary tread is pitch-adjustable within a range of rotation about the hinge axis 520. The pitch adjustment allows the system to accommodate floor-to-floor heights which differ from a height exactly corresponding to the target angle θ (given the discrete adjustments associated with only having the option of integral numbers of fixed height and separation assembling).

For example, if the exact floor-to-floor height is slightly greater than the height associated with a given number of treads, then θ will be slightly greater than the target θ. If the treads are in an initial neutral position (e.g., in the middle of their range of rotation about the axis 520) they will be pitched slightly downward (so that the upper surface descends from the hinge outward). This may be compensated for by adjusting the pitch in the opposite direction. An exemplary pitch adjusting mechanism comprises a screw (bolt) and nut combination at left and right ends of the tread (left and right sides of the assembly). In an exemplary implementation, a screw 200 has an upper end 202 (e.g., a head) engaging the underside of the tread and secured against rotation about the screw axis 530. The head may be mechanically captured (e.g., in a recess or by brackets or may be otherwise secured). A threaded shaft 204 depends from the head. A nut 210 (e.g., a star nut) is axially/vertically captured by the associated side portion of the stair assembly (e.g., between upper and lower flanges 212 and 214) which may be welded to the associated side portion. Rotation of the nut (e.g., via fingers or a wrench) in one direction causes the pitch to increase; whereas in the opposite direction causes the pitch to decrease. Alternative implementations may involve capturing the nut against rotation and allowing the screw to rotate.

The exemplary system may also include one or more handrails 268. Exemplary handrails are provided by individual handrail members associated with individual tread assemblies. Depending upon the situation, one, two, or no handrails may be installed. For example, if a given side of the stair is against a wall, installing the handrail may be optional. If a side of the staircase is open, installing a handrail may (under safety code or regulation) be required. For mounting each handrail member, each side portion includes mounting features. Exemplary mounting features comprise one or more upward projections from the web of the side portion. Exemplary upward projections are formed in a pair of upper and lower projections 270A and 270B. Exemplary projections are tubular bosses extending vertically upward (i.e., at the nominal angle θ relative to the web). These may be short stubs secured to the web 156 via welding. Each exemplary handrail 268 includes a respective upper vertical member (upright or baluster) 280A and lower vertical member 280B each extending from a lower end 282 to an upper end 284. The exemplary upper ends are formed at respective upper and lower ends of a rail portion 286. The uprights 280A, 280B and rail 286 may be formed from a single tubular piece by bending. The exemplary rails are dimensioned to receive the bosses 270A, 270B when the rails are installed. The uprights may be secured to the bosses via pins 290 (e.g., extending through diametric through holes in the bosses and uprights). The exemplary handrails include means for filling the gap between each upper upright and lower upright (e.g., longitudinal crossbars 292 welded therebetween). The cross bars may be positioned to satisfy the relevant code for maximum allowable gap. Similarly, the uprights may be positioned so that the gap between a given upper upright and the lower upright of the next tread assembly above is no greater than the maximum allowed under code.

As noted above, in operation the floor-to-floor height may be measured or otherwise determined. This may be used to determine the appropriate length of each stringer. The stringers may be set to such length and installed (although not necessarily in that order). For example, the stringer may be secured at one end in an initially extended or contracted condition and then relatively contracted or extended to the final length and then secured at the other end. At some point during this process, one or more transverse spacer bars may be secured across the two stringers to maintain their predetermined separation to allow tread installation. Exemplary spacers are aluminum bars with predrilled holes corresponding to associated predrilled holes near an upper end of the upper members and a lower end of the lower members. The spacers may be secured to the members via screws, pins, or the like. After securing the stringers to the floors, the tread assemblies may be installed. Exemplary tread installation is one-by-one starting from the bottom. After tread installation, the rails (if any) may be installed (if not already installed). Removal may be via a reverse of this process with the tread assemblies being removed from top-to-bottom by an initial upward longitudinal shift which brings the mating features of tread assembly and stringer into a removal orientation (e.g., aligns the projection head 164 with the upper end portion 122 of the associated keyhole). The tread assembly may then be removed via an upward extraction normal to the longitudinal direction. After the tread assemblies are removed, the stringers may be unsecured from the floors. Optionally, such a system may be used on a more permanent basis if it meets code for a permanent installation.

Although exemplary English dimensions are shown for the typical US installation in view of typical US codes, other dimensions are possible and would be likely in other jurisdictions with other codes and other standard sizes of component.

Other variations replace the upper hinge with a single bracket that mounts to the upper floor .The stringers then have hooks to engage this fixture. This can remove the need for a separate upper spacer bar. Similarly, a lower fixture may replace the lower spacer bar. For example, a lower fixture may have pockets that receive the distal portions of the lower hinges. After such reception, the stringers can be rotated down to mate the upper hooks with the upper fixture.

Other variations involve use of some or all of the foregoing system components and features in a free-standing staircase. A subset of free-standing staircases involves movable (i.e., as a unit) staircases. One example includes a frame for supporting the stringers at the desired nominal angle θ. Among variations, the frame may be equipped with wheels (e.g., lockable or stowable for stability). The frame may also carry an upper platform/landing at the upper end of the stringers in place of the upper floor previously described.

Exemplary materials for the major structural pieces are aluminum alloys (e.g., aircraft aluminum 7075 for lightness). Exemplary hardware such as hinge pins, locking pins, screws/bolts, nuts, springs, and the like are of stainless steel. This can facilitate indoor/outdoor use. Exemplary stringer inner and outer members are extruded from such exemplary aircraft aluminum or 6061 aluminum alloy. Similarly, exemplary treads may be extruded (e.g., to provide a nosing feature along the tread front). A traction coating or applique may be applied to the treads. The side portions may also be extruded in channel form or may be assembled (e.g., welded of sheet/bar/strip stock). An exemplary system allows use with a floor-to-floor height of up to 144 inches.

Figure 12:
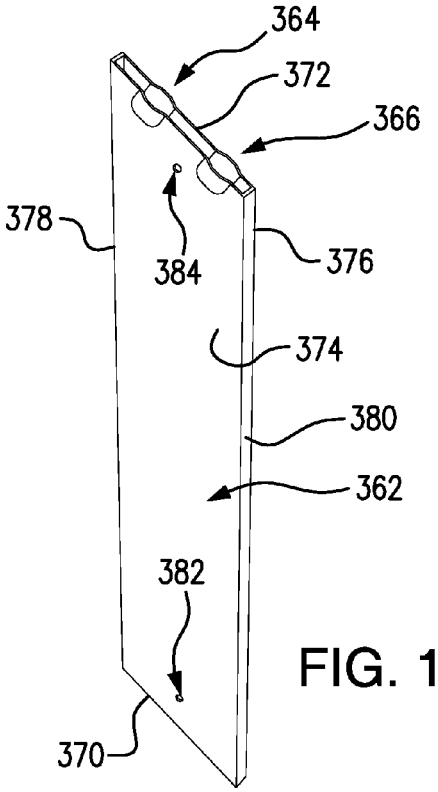
FIG. 12 is a view of a second baluster used in the staircase of FIG. 10.
Figure 13:
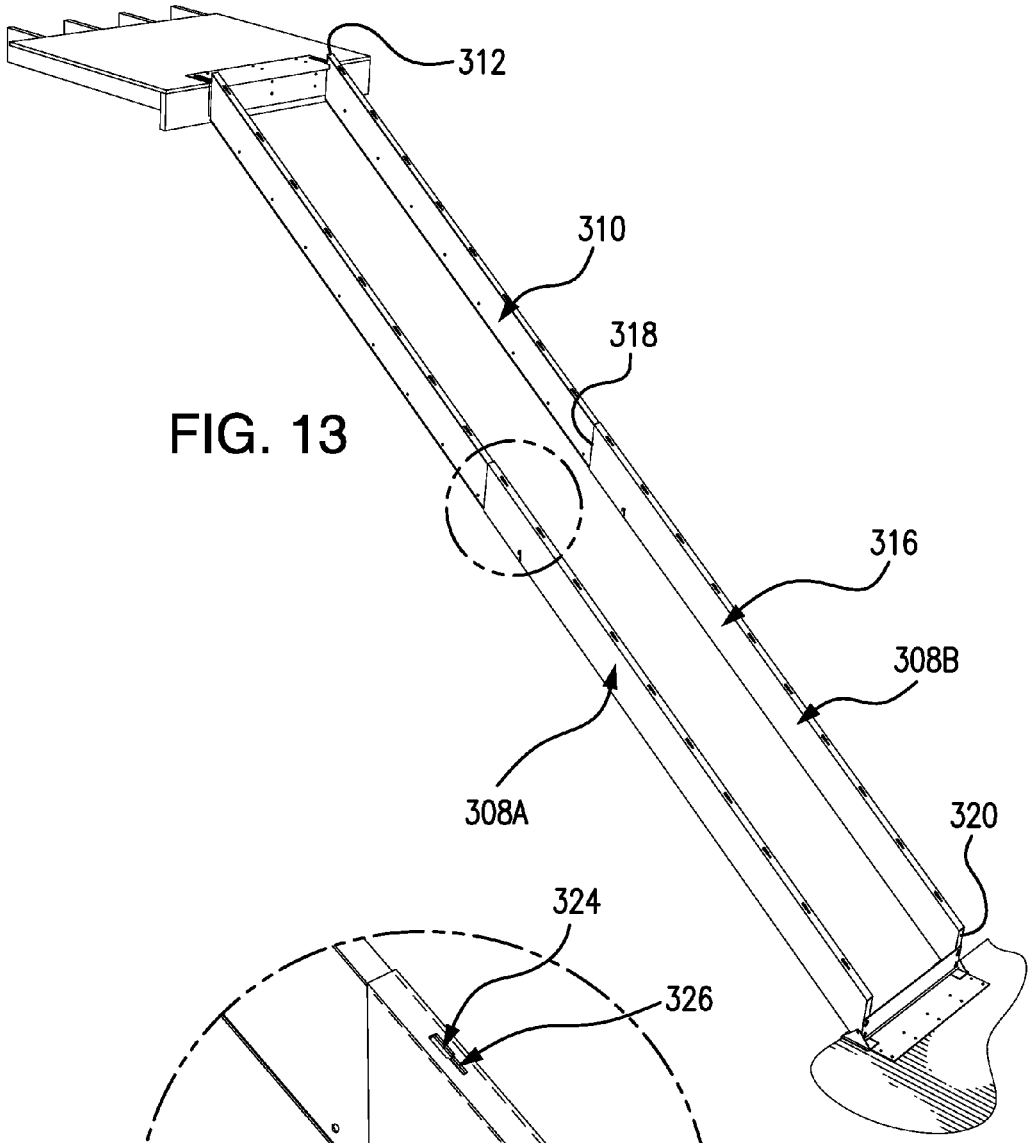
FIG. 13 is a view of stringers and top and bottom plates assembled for forming the staircase of FIG. 10.
Figure 13A:
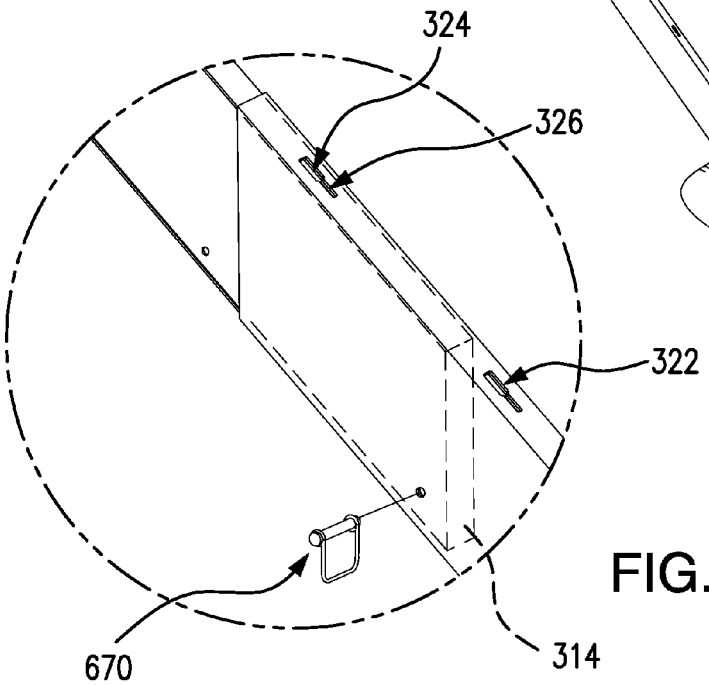
FIG. 13A is an enlarged view, designated by numeral 13A in FIG. 13, of a stringer joint.
Figure 14:
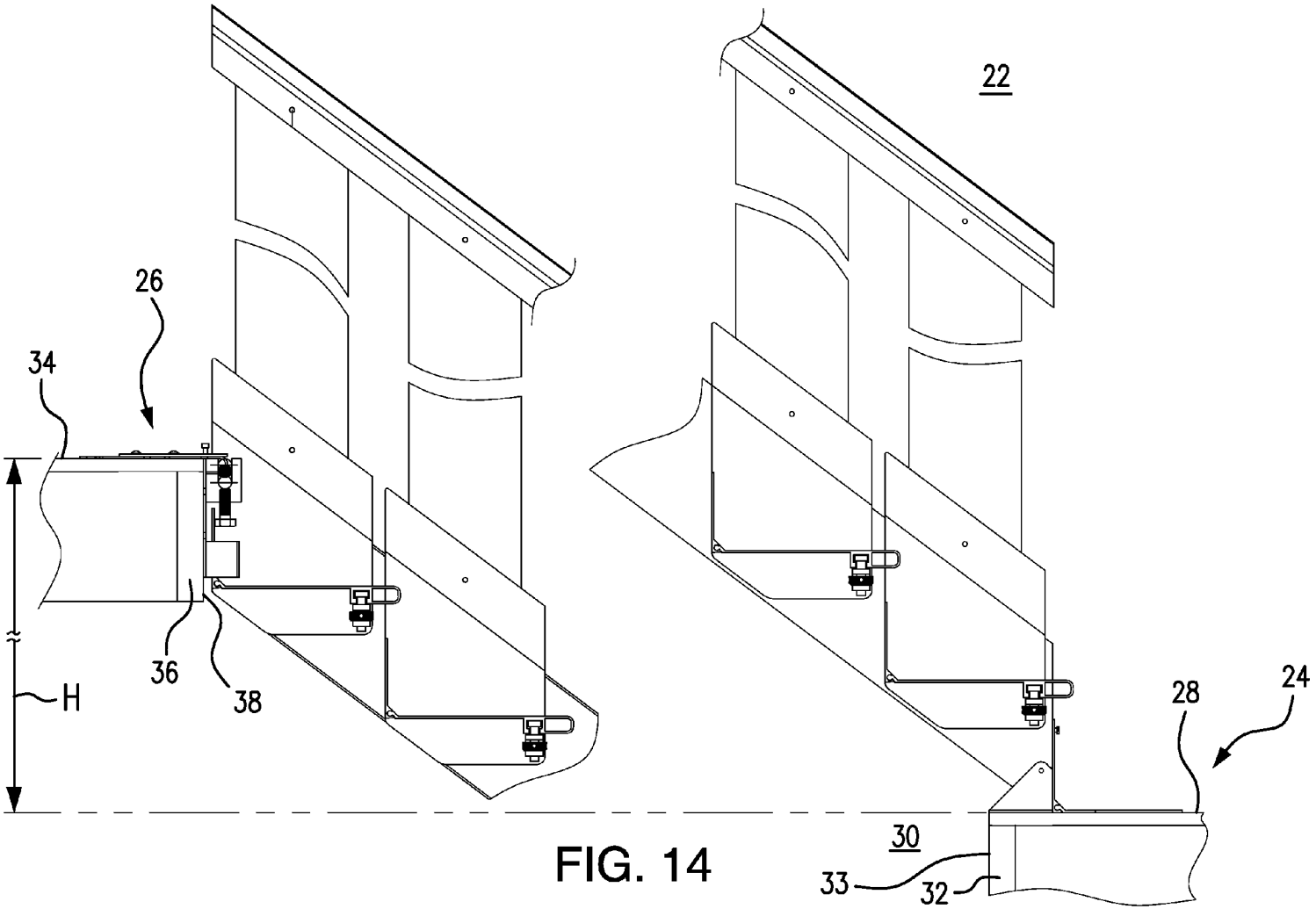
FIG. 14 is a cutaway partial side view of upper and lower portions of the staircase of FIG. 10.

The second embodiment (staircase) 300 (FIG. 10) has several differences in construction/operation involving telescoping handrails 302A, 302B and upper 304 and lower 306 mounting fixtures in place of upper and lower pairs of individual hinges. Otherwise, materials and manufacture and use methods may be the same or similar to those above. For purposes of reference, gross features include left 308A and right 308B stringers (stringer assemblies) shown in FIG. 13. Each stringer assembly comprises an upper/inner member 310 extending from an upper end 312 to a lower end 314. Each stringer assembly further comprises an outer/lower member 316 extending from an upper end 318 to a lower end 320. The inner and outer members include tread assembly attachment features 322 (FIG. 13A-e.g., holes/slots along stringer upper surfaces having wide upper portions 324 and narrow lower portions 326). FIG. 12 shows the upper member 310 cross-section as defining upper 330, lower 332, left 334, and right 336 sides. Similarly, the lower member cross-section defines upper 340, lower 342, left 344, and right 346, sides. An individual tread assembly is shown as 350 in FIG. 11.

There are several noteworthy differences in construction relative to the staircase of FIG. 1.

Figure 21:
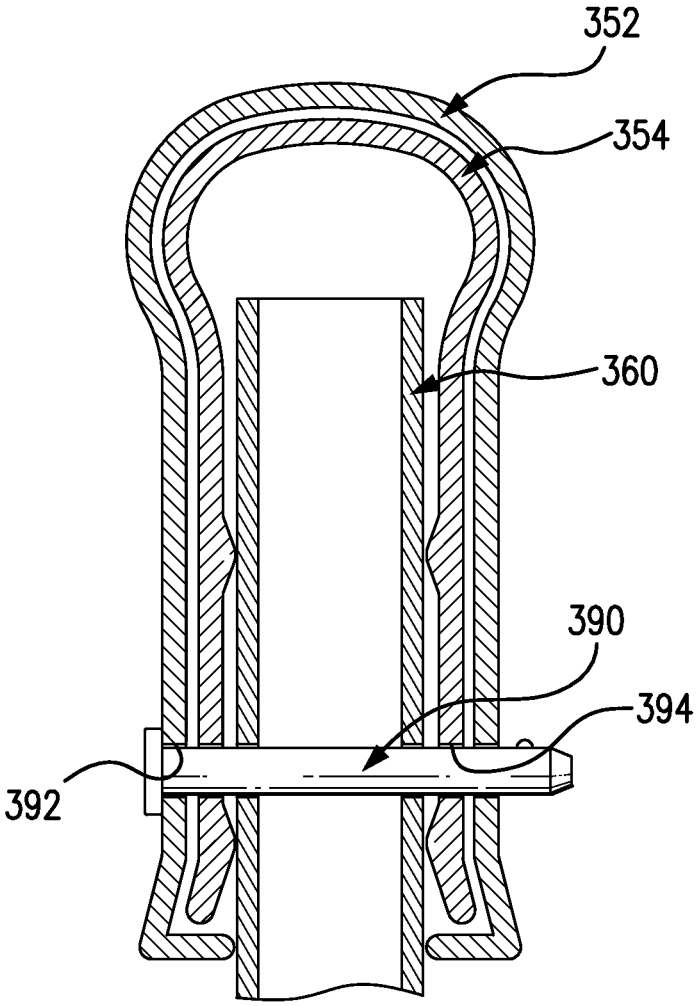
FIG. 21 is a transverse sectional view of an intra-baluster joint.
Figure 22:
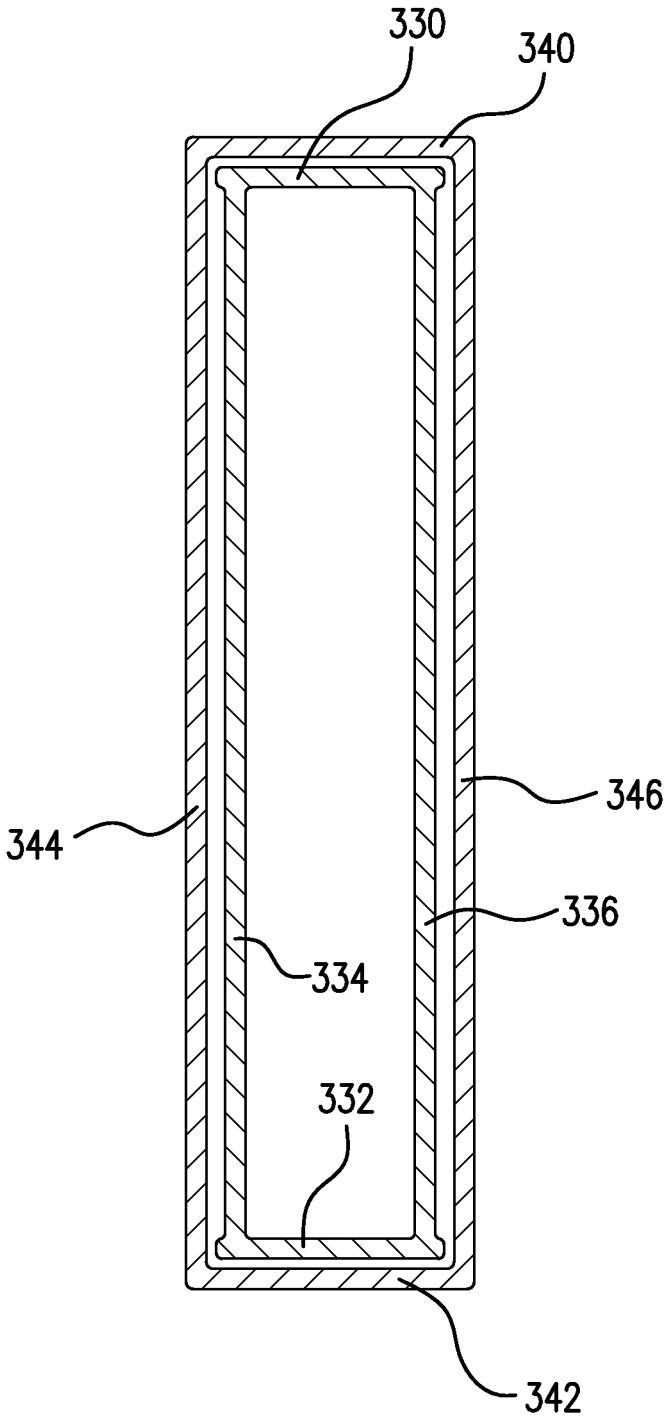
FIG. 22 is a transverse sectional view of a stringer.

First, at each side, there is a single continuous (no vertical gaps) handrail 302A, 302B (e.g., an assembly of aluminum outer (352)/inner (354) extrusions-FIG. 21) that telescopes similarly to the stringers. In one embodiment, the outer extrusion or member 352 is an upper member and the inner member or extrusion 354 is a lower member. This provides a smoother perceived transition if one is descending the stairs with hands sliding along the handrail. The exemplary outer/upper member 352 extends from an upper end 355 to a lower end 356 and the exemplary lower/inner member 354 extends from an upper end 357 to a lower end 358. The cross-section (of each extrusion 352, 354) is downwardly open and has a bulbous closed upper end for hand gripping.

At each side, each overall tread assembly or stair unit comprises the basic tread assembly 350 plus at least one baluster attached to each side for connecting to the handrail. The baluster upper ends are received through the open lower end of the handrail cross-section and secured via fasteners such as pins, or screws. In the exemplary implementation, there is a single left side baluster and a single right side baluster each formed of a rectangular box cross-section (e.g., extruded aluminum) identical to each other. In the exemplary implementation, there are two different types of baluster. One type of baluster 360 is of said rectangular sectioned extrusion of the exact width to fit within the inner handrail extrusion 354 (FIG. 21). A second type baluster 362 (FIG. 12) is otherwise the same as the first 360 but, near its upper edge/end is flared outward on both side surfaces to create a respective upper and lower widened areas 364 and 366 of width to more closely and stably fit within the outer extrusion 352. Both the balusters 360 and the balusters 362 are otherwise similar to each other and extend from a lower end 370 to an upper end 372 and have first and second lateral sides 374 and 376 and upper and lower cross-section ends or baluster edges 378 and 380. Near the lower end 370, a fastening hole 382 extends through both sides of the cross-section (inboard and outboard sides of the baluster) for securing to the tread assembly 350. Similarly, near the upper end 374 a hole 384 extends through both sides for securing to the associated handrail extrusion(s). FIG. 21, for example, shows one of the balusters 360 at the junction between handrail extrusions wherein a pin 390 (e.g., a flat-head, spring-loaded, ball detent pin) extends through apertures 392 on both sides of the outer extrusion and apertures 394 on both sides of the inner extrusion. Such detent pins may be provided in two lengths: a shorter length for attaching to the balusters 360 along the inner extrusions 354 only; and a longer length for attaching the balusters 362 to the outer extrusions 352 and attaching the one or more balusters 360 along any overlapping region of the baluster extrusions.

In alternative implementations, each side of each tread unit may have a pair of balusters/posts (e.g., aluminum tubing) joined by a sheet metal web.

Figure 5:
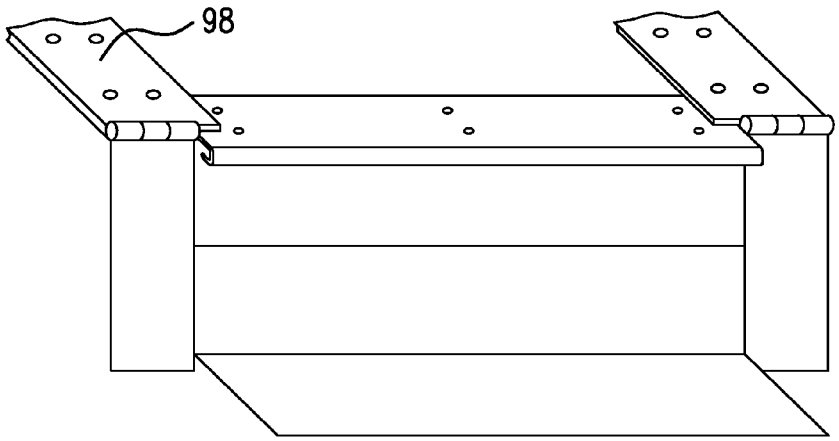
FIG. 5 is a view of a top plate assembly.
Figure 6:
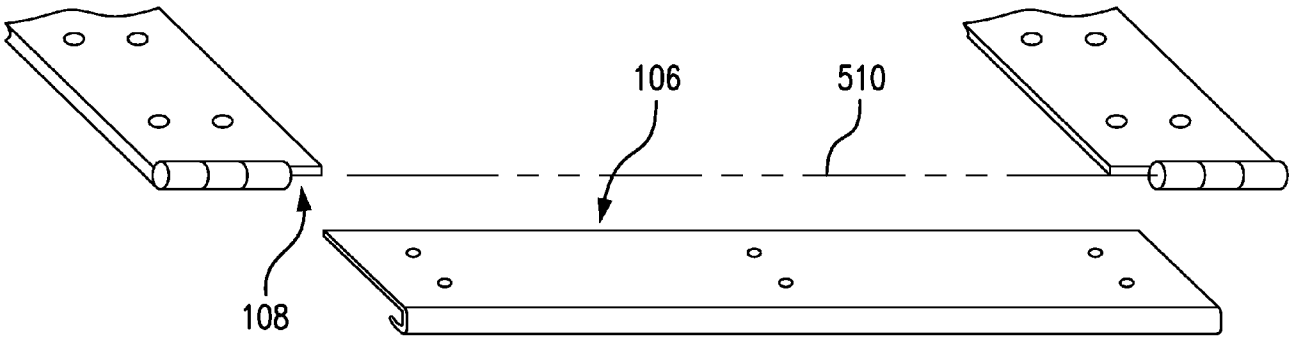
FIG. 6 is an exploded view of the top plate assembly of FIG. 5.
Figure 7:
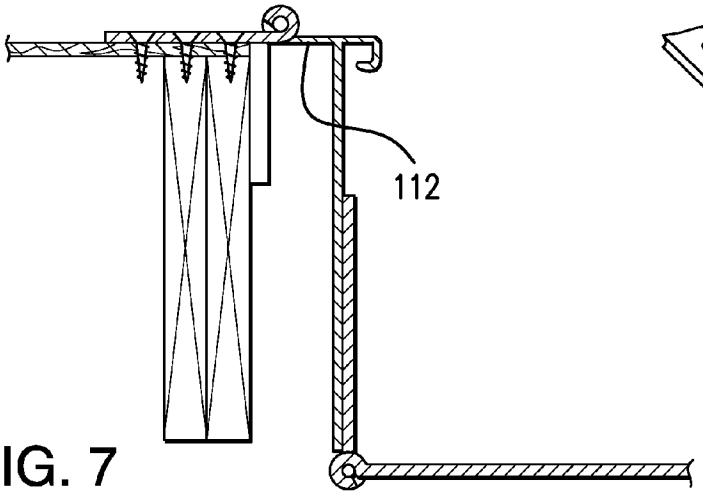
FIG. 7 is a side view of the top plate assembly of FIG. 5.
Figure 9:
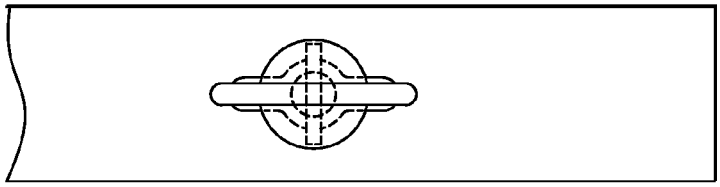
FIG. 9 is a bottom view of the stringer of FIG. 8
Figure 8:
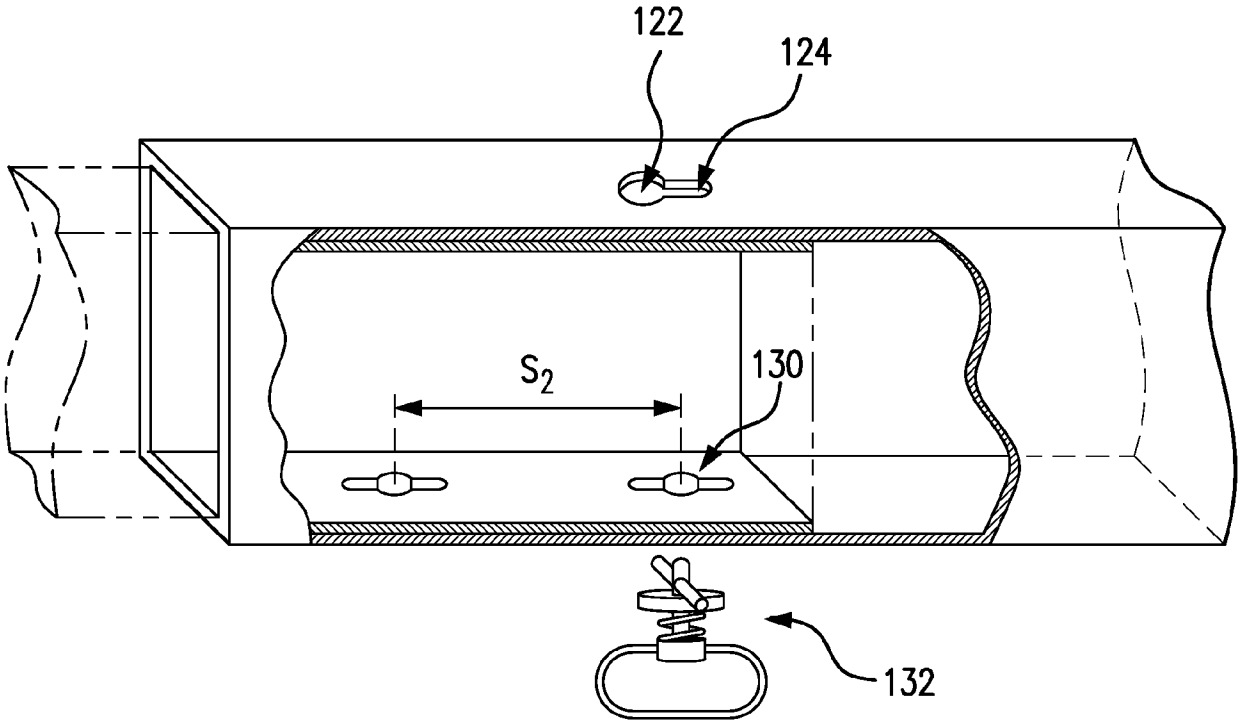
FIG. 8 is a cutaway view of a telescoping stringer.

FIG. 5 shows the basic tread assembly 350. This includes a tread member (e.g., aluminum alloy extrusion) 400 and a riser member (e.g., aluminum alloy extrusion) 402. The exemplary tread extrusion 400 is extruded with traction ribs 403 along its upper surface. The tread extrusion 400 and riser extrusion 402 are formed with an integral hinge 404. The exemplary hinge 404 is formed by a generally circular sectioned protrusion 406 on one of the members (e.g., a rearwardly projecting protrusion 406 along a rear edge of the tread extrusion 400) received within a complementary circular sectioned socket/channel 408 in the other (e.g., a forwardly open channel along an enlarged bottom edge portion of the riser extrusion 402). The exemplary tread extrusion comprises a forward end/edge 410 formed along a laterally closed channel 412 which provides a box structure for strength and also a bull nose feature for convenient ergonomic tread functioning. The exemplary traction ribs 403 extend along at least an upper portion of the bullnose. Behind the bull nose is a downwardly open channel structure 414 defining a channel 416 for receiving bolt heads 418 of height adjustment bolts 420 (functioning as jack screws) having downwardly extending threaded shafts 422. The channel structure 414 captures the bolts against rotation and may have slightly inwardly projecting rim lips 424 capturing undersides of the bolt heads to vertically retain the tread relative to the bolts.

Figure 15:
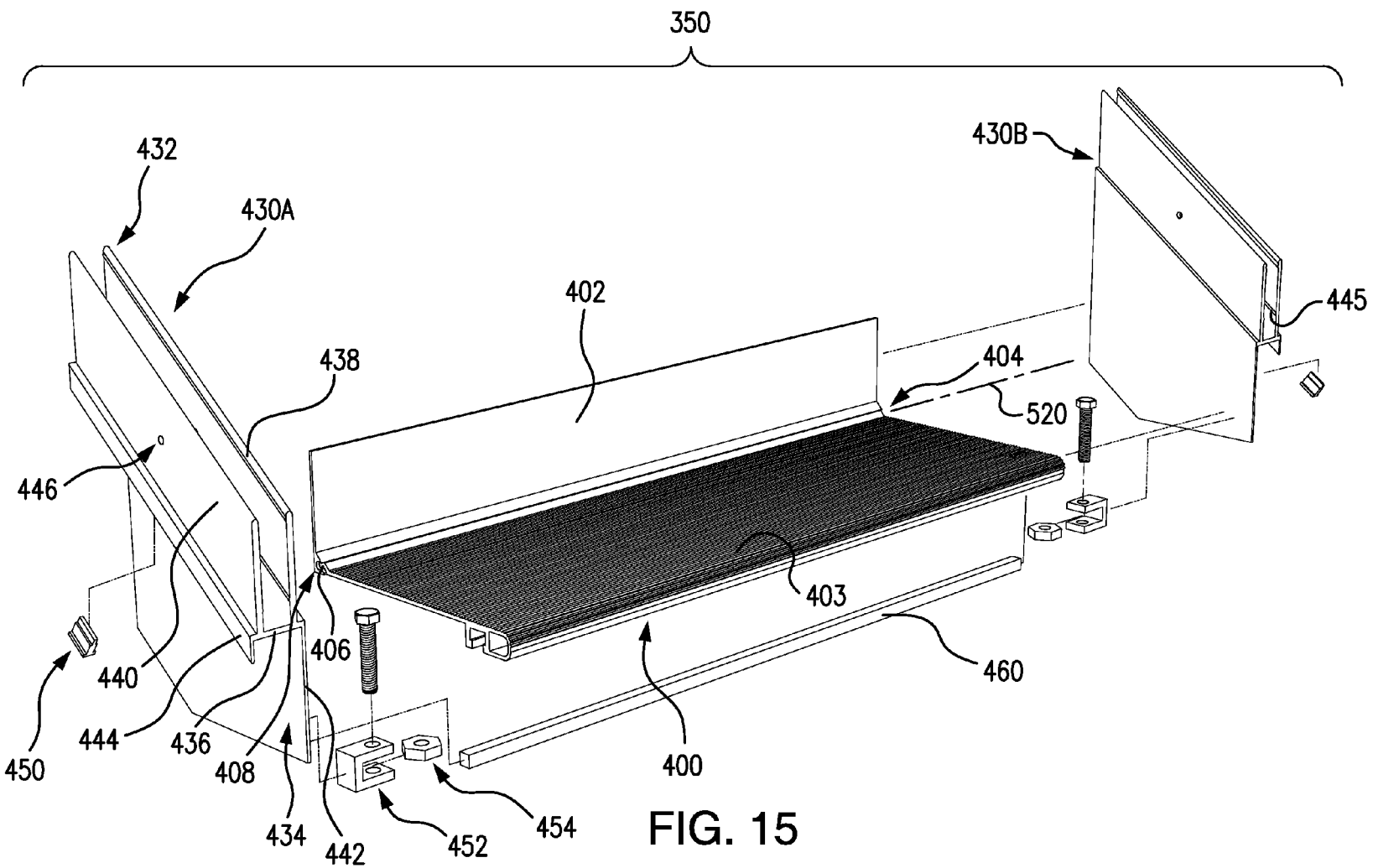
FIG. 15 is an exploded view of a tread assembly.

Each basic tread assembly 350 (FIG. 15) includes a respective left side member 430A and right side member 430B for mounting to the respective stringer. These may be formed of aluminum extrusions and may represent the same extrusion merely cut at different angles. Each exemplary extrusion 430A and 430B comprises an upwardly open upper channel portion 432 and a downwardly open channel portion 434 joined at their shared base web 436. The upper channel comprises an inboard wall 438 and an outboard wall 440 and the channel 434 comprises an inboard wall 442 and an outboard wall 444. The upper channel walls are extruded with ribs 445 for gripping the balusters.

The upper channel 432 receives a lower end portion of the associated baluster and has a hole 446 through both its walls 438, 440 to, in turn, receive a detent pin or other fastener which also extends through the baluster bottom hole 382 (FIG. 12). The lower channel 434 receives the associated stringer with the channel base resting along the stringer top. In the exemplary implementation, each side member further includes a key 450 secured within the channel 434 for engaging an associated hole in the top of the stringer. The exemplary key 450 is of inverted T cross-section and may be welded in place (e.g., with a rebated base of the leg of the T being received in a machined slot in the web 436 prior to welding thereto). The head of the T is dimensioned to just fit through the slot upper portion 324 and be captured beneath the slot lower portion 326 upon installation of a tread assembly in similar fashion to that described above.

For height adjustment, each side member further includes a clevis 452 (e.g., of aluminum alloy extrusion) which may have a base welded to the inboard face of the inboard wall 442. Each of the clevis arms includes a hole through which the associated bolt shaft 422 freely passes. A height adjustment nut 454 is closely accommodated between the clevis arms and receives the shaft 422. Rotation of the nut 454 in opposite directions respectively raises or lowers the bolt, and therefore the front end of the tread extrusion, causing the tread extrusion to rotate about its transverse hinge axis. Thus, the underside of the tread along the bolt-receiving channel structure 416 transfers weight to the bolt head 418 which, in turn, transfers weight through the bolt to the nut 454 and, therefrom, to the lower arm of the clevis 452 and, therefrom, to the inboard wall 452 of the channel 434 and therethrough to the web 436 and the stringers.

To physically/structurally connect the two side members 430A, 430B, the edges of the riser extrusion (ends when measured along the direction of extrusion) are welded to the adjacent inboard walls 442 of channels 434 along the rear end of the walls 442 and side members. At the front, a transverse brace 460 (e.g., aluminum alloy bar stock) may also be welded below the tread extrusion with respective ends welded to the respective walls 442.

Figure 16A:
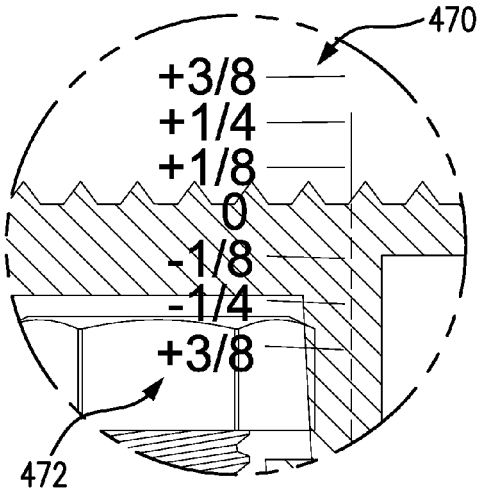
FIG. 16A is an enlarged view, designated by numeral 16A in FIG. 16, showing adjustment indicia.
Figure 16:
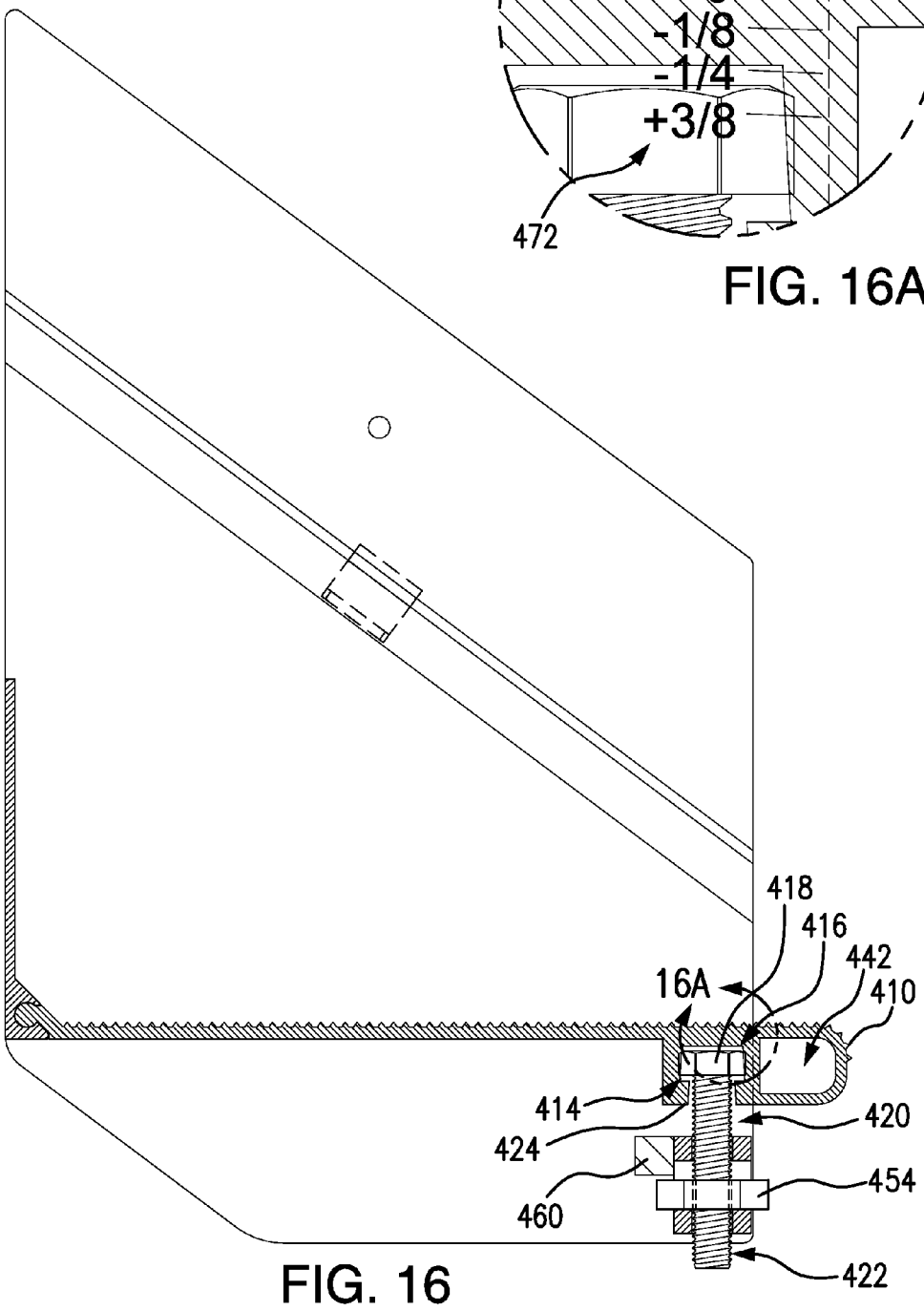
FIG. 16 is a longitudinal vertical sectional view of the tread assembly of FIG. 15.
Figure 17:
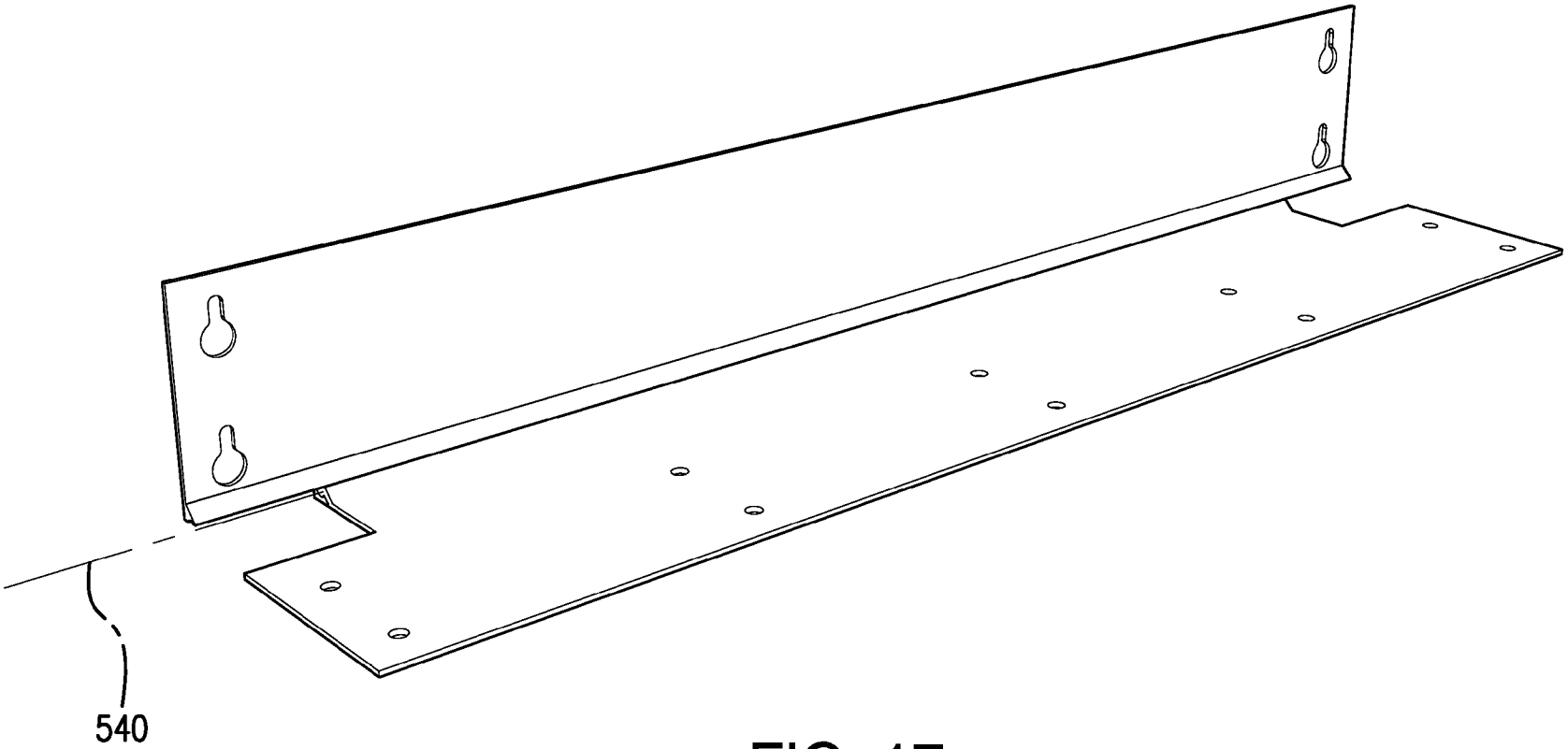
FIG. 17 is a view of a bottom plate assembly.

As is discussed further below, FIG. 16A shows inboard faces of the walls 442 as bearing indicia (e.g., hash mark indicia 470 and alphanumeric indicia 472) for height/angle adjustment of the tread. The exemplary alphanumeric indicia are for actual tread rise in inches.

One alternative indicia would be a delta value from a nominal tread rise. Other variations of such indicia include angles. The other indicia are non-descriptive (e.g., A, B, C, and the like each indicating one of the nominal tread heights).

Figure 18:
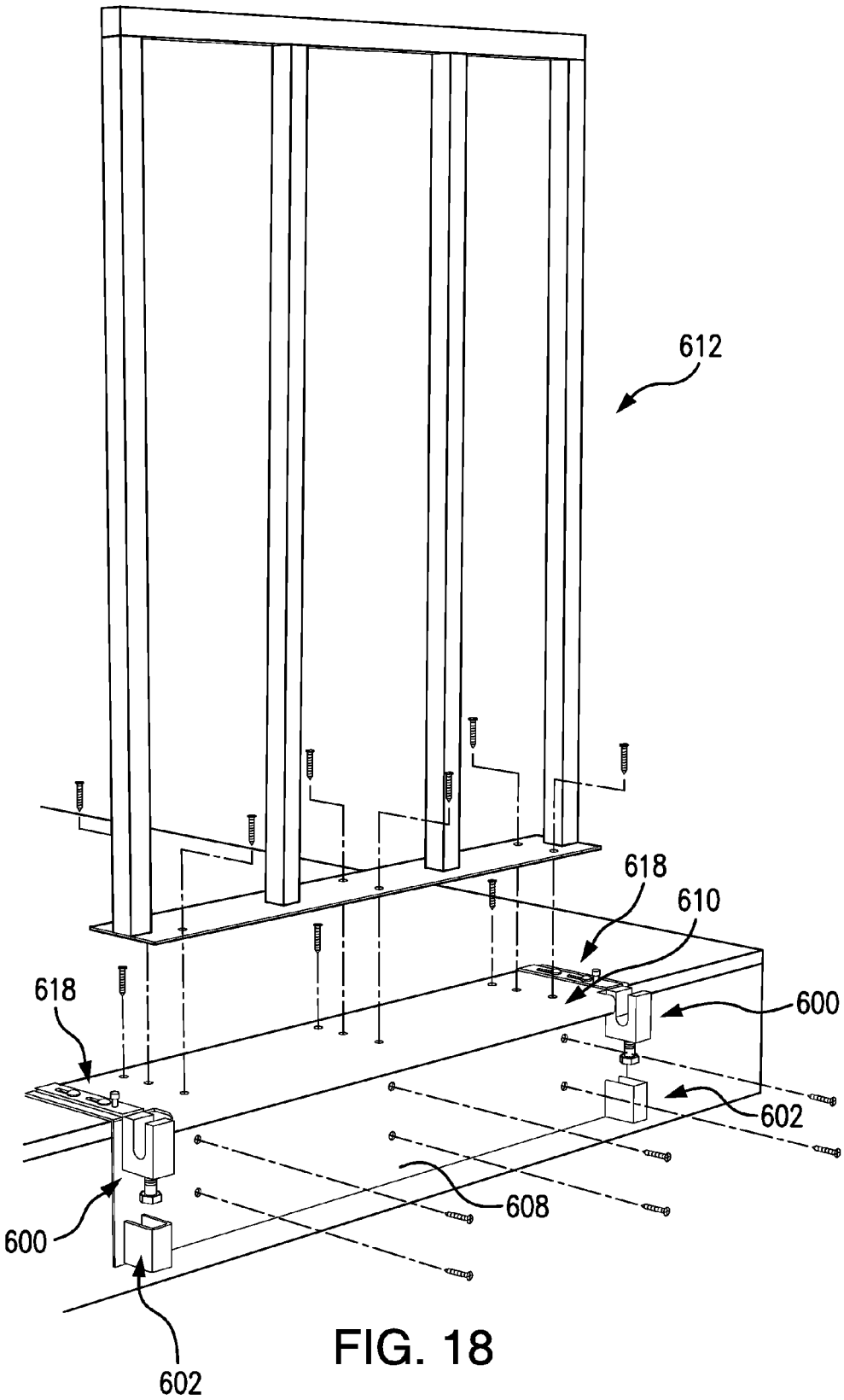
FIG. 18 is an exploded view of a top plate assembly and safety barricade combination.

To mount the stringer upper ends, the upper floor mounting fixture (top mounting plate assembly-FIG. 18) has left and right pairs of upper 600 and lower 602 mounting features protruding in front of the upper floor header. The exemplary features 600 are hooks (upwardly open) whereas the exemplary lower features 602 are merely projections that are received in the open stringer upper ends (open portions of the upper ends of the stringer inner extrusions). Alternative embodiments may involve upper and lower hook pairs. Each hook 600 is received in the associated open upper stringer end and engages/receives a transverse rod/pin (e.g., aluminum alloy rod 604 (FIG. 19) welded to the stringer upper member) within the stringers to hang the stringers from the upper floor. The exemplary members 600 and 602 each comprise an aluminum alloy extrusion welded to the vertical plate 608 of the top mounting plate assembly. The exemplary top mounting plate assembly comprises the combination of this vertical plate 608 and a tread 610 which may be formed of an extrusion similar to the tread extrusion 400 of the tread assemblies. An upper edge of the vertical plate 608 abuts an underside of the tread 610 and is welded thereto. In an initial stage of installation, these may be respectively screwed to the joist face and floor surface (FIG. 18). Additionally, at the initial assembly, a safety barrier/barricade/gate 612 may also be secured in place (e.g., atop the tread 610). The barrier 612 may be removed upon completion of installation and reinstalled at the beginning of a disassembly/removal process performed as a reverse of the assembly/installation process.

Figure 19:
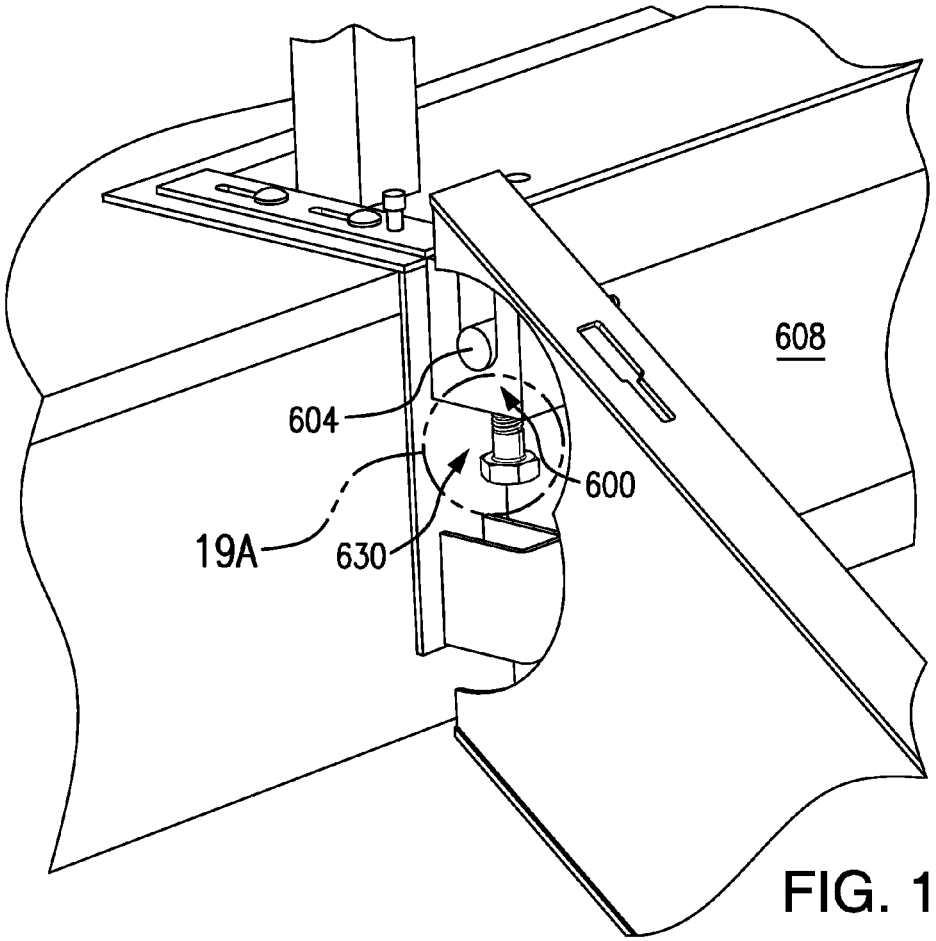
FIG. 19 is a cutaway view of a stringer-to-top assembly joint.

After the stringers are initially hung in place, to prevent their removal, a slider 618 (slide lock —e.g., aluminum alloy strip stock) at each side of the top mounting plate assembly slides through the open end of the associated stringer upper member and over the upper hook and pin. FIGS. 18 and 19 show the slider in its retracted/unlocked condition. The exemplary slider slides via a pair of elongate apertures cooperating with rivets, screws, or other fasteners extending into the tread 610. FIGS. 18 and 19 also show each slider as having a small upwardly protruding handle (e.g., an aluminum alloy rod welded to the strip stock).

Figure 19A:
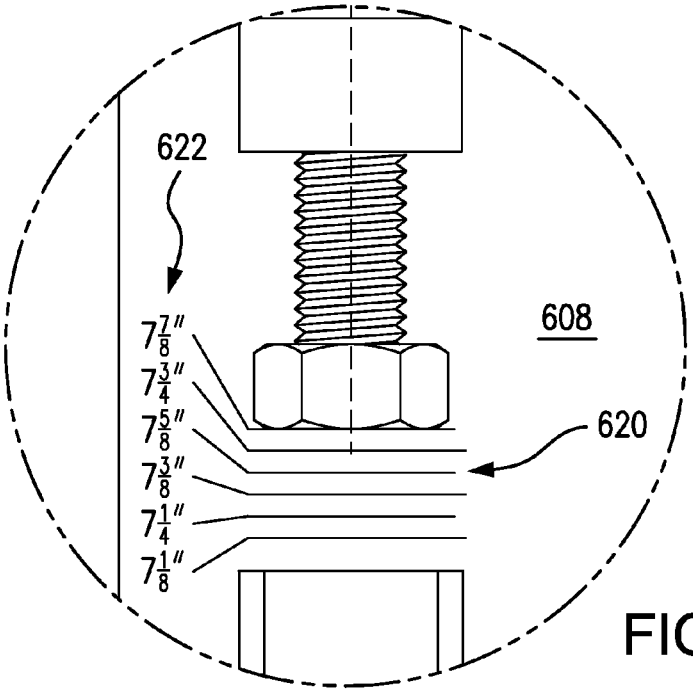
FIG. 19A is an enlarged view, designated by numeral 19A in FIG. 19, showing adjustment indicia.

Means for vertical height adjustment of the stringers is also provided. Exemplary means vertically adjusts the height of the stringer upper ends relative to the upper floor while not effecting position of the stringer lower ends. Exemplary means comprises a bolt 630 having a threaded shaft extending within a threaded bore in the base of the channel 600 so that the end of the threaded shaft engages the underside of the rod 604. Tightening of the bolt 630 thus raises the rod and associated stringer whereas loosening lowers. The exemplary vertical plate 608 also includes registration indicia 620, 622 (FIG. 19A) for indicating the relative height adjustment. These may be of similar form to the combined hash mark and alphanumeric indicia of FIG. 16A.

To mount the stringer lower ends, the stringer lower ends are provided with a combination of hinged feet 640 and features for mating with the lower floor mounting fixture 306. The exemplary hinged feet 640 are similar to hinged feet used on extension ladders and the like (having webs extending upward along either side of the stringer and secured thereto with a hinge pin for rotation about a hinge axis 541). The lower floor mounting fixture (bottom mounting plate assembly) has a hinged riser portion 650 (hinged relative to a base portion 652 screwed to the lower floor) which has mounting holes 654 that receive pins 656 protruding from ends of the stringer lower members. Each stringer has a pair of upper and lower pins 656 (e.g. aluminum alloy pins welded to end plates of the stringers) The holes have enlarged lower portions for passing the pin heads during installation/removal and narrower upper portions for capturing the pin shafts/shanks in installed conditions. This allows the stringers to initially be put into an approximate position with the feet 640 on the floor. Thereafter, the riser 650 may be inserted and dropped into place during which process, the stringer separation may be adjusted to fit the spacing between the holes 654. Thereafter, the plate 652 may be screwed to the floor holding the stringers laterally, vertically, and front-to-back (with the shanks of the pins 656 trapped in the narrower upper portions of the holes 654). An exemplary cooperation between the plates 650 and 652 is via a hinging similar to that of the tread assembly tread extrusion and riser extrusion. In the exemplary embodiment, the lower edge of the plate 650 has a downwardly open circular sectioned channel receiving a complementary upwardly-protruding circular sectioned protuberance along the rear edge of the plate 652 to create the hinge having a transverse hinge axis 540. With the stringers secured to the top and bottom mounting plate assemblies, the stringer separation is fixed, thereby facilitating installation of the tread assemblies.

Figure 20:
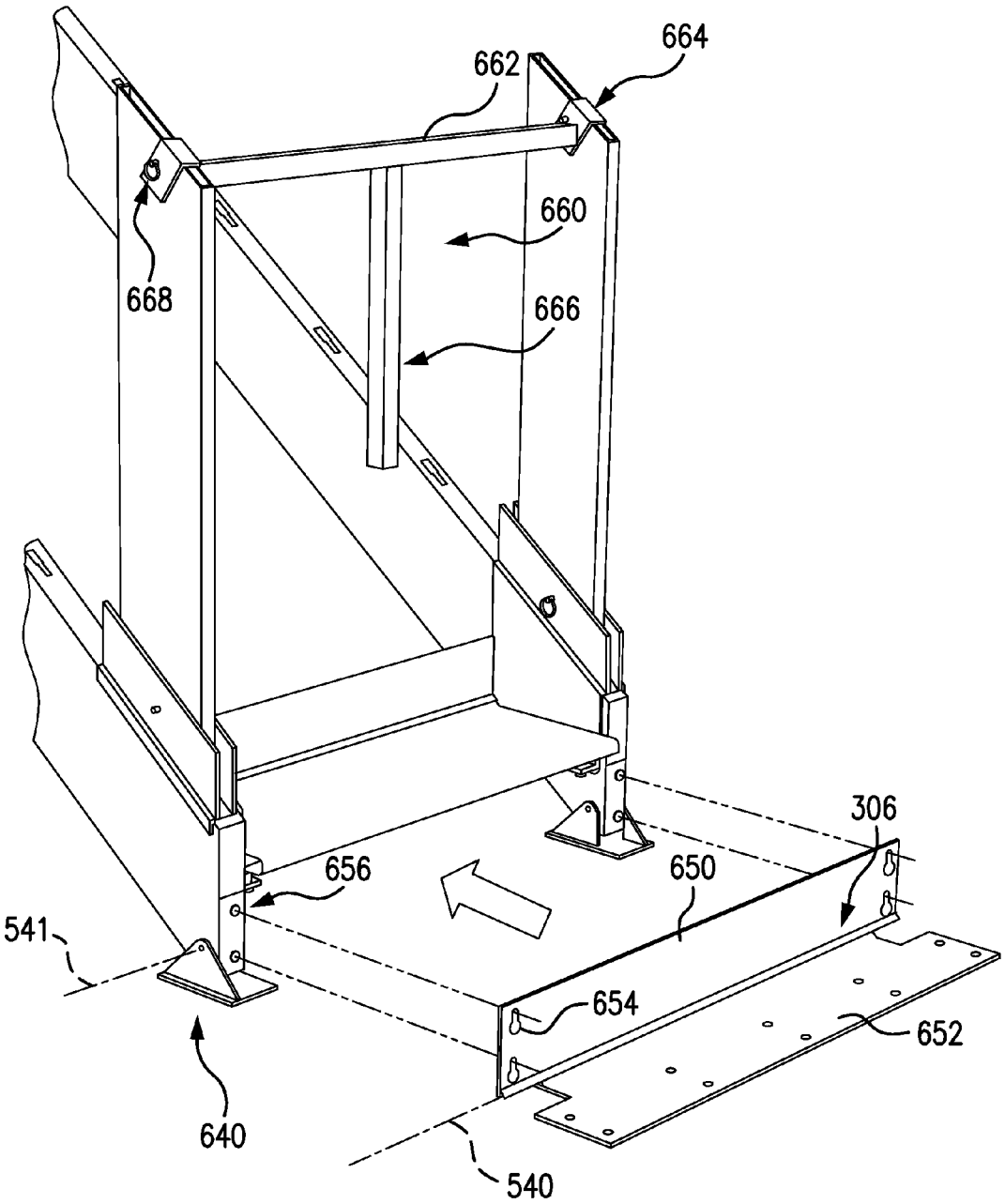
FIG. 20 is an exploded view of a stringer-to-base plate assembly joint.

FIG. 20 further shows a lower safety bar 660 which complements the upper safety barrier/gate 612 of FIG. 18. During assembly, the lower safety bar 660 may be installed on the lowest completed tread assembly/baluster assembly. This prevents someone from walking up an incompleted series of stairs and falling through a gap. During disassembly of the system, the lower safety bar 660 may be installed upon the next lower tread assembly below that being removed at any given time. The exemplary safety bar 660 is formed of welded aluminum alloy comprising a transverse bar (e.g., square sectioned tubing) 662 and having downwardly open right channels (e.g., extrusions) 664 at opposite ends with inboard walls of the channels welded to adjacent ends of the bar 662. One or more vertical bars 666 may have an upper end welded or otherwise secured to the bar 662 and depending therefrom to extend between the balusters. The channels 664 have apertures in their adjacent walls for receiving detent pins 668 or other fasteners going through the channels and through the upper holes 384 of the associated balusters.

Figure 10:
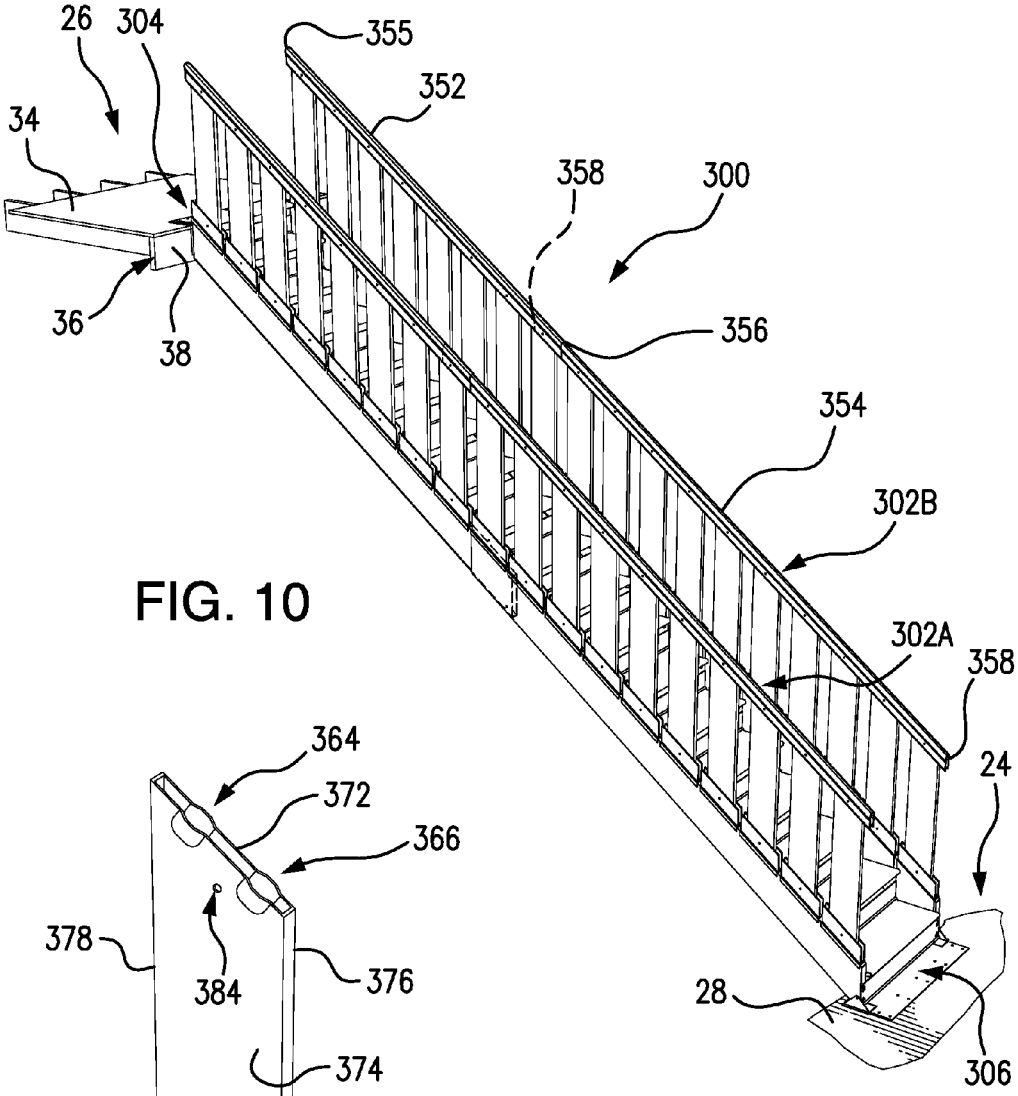
FIG. 10 is a view of a second staircase.
Figure 11:
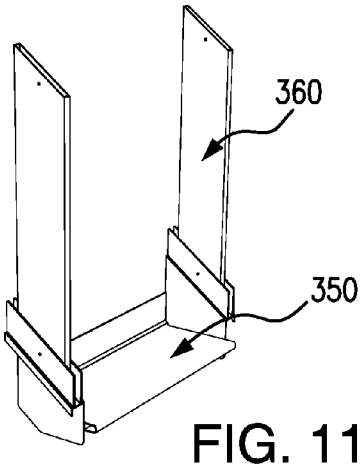
FIG. 11 is a view of a tread assembly and baluster pair of the staircase of FIG. 10.

In the FIG. 10 embodiment, each stringer is lockable via a transverse pin 670 (FIG. 13A) through sides of the members rather than through the bottoms of the rectangular cross-sections of the members.

An exemplary process for using the system (described relative to the second system 300 but also applicable to the first system) involves first calculating the number of tread assemblies required. The floor-to-floor height H is obtained such as by physical measuring or from prints or a computer model. H is then divided by the nominal rise R and the result rounded to the nearest full number to provide the nominal rise count. The number of tread assemblies needed is, therefore, one fewer than the nominal rise count. The inner stringer extrusion may be marked with hash marks and corresponding numerical indicia indicating the number of steps. For example, the hash marks may align with the open end of the outer member that receives the inner member. The stringers may be adjusted to length (e.g., via gradations marked to correspond to tread count) and secured via the aforementioned pin (670) or other fastener going through the single pair of holes in the outer member and whatever pair of holes in the inner member is associated with the particular tread count.

H is then divided by the nominal rise count to obtain a target actual rise. The target actual rise can then be used to adjust the top plate setting and the treads. For example, the adjusters associated with both may be marked with gradations (the indicia above) identifying either the target actual rise or a deviation from the nominal rise. In the exemplary implementation, the nominal rise in accordance with standard US building codes is 7.5 inches. Both the individual treads and the top plate have a marked range of adjustment of three-quarters of an inch. On the top plate, this is marked merely with the actual target rise values (from seven and one-eighth to seven and seven-eighths holes). For compactness, the exemplary tread assemblies mark only the deviation plus or minus from the nominal height (from −⅜ inch to +⅜ inch). In the US-standard example, the gradations are in eighths of an inch. The calculation of the target actual rise may involve rounding to the nearest eighth of an inch in such a situation (or, alternatively, sixteenth of an inch). This may be used to generate tables associating the tread assembly count and adjustments with the floor-to-floor rise. The top plate may be installed to the upper floor along with the barricade as noted above. For convenience, the height adjustment of the top plate may be performed before this installation.

After the stringers are adjusted to length, they may be hung from the top plate and the locks shifted forward to lock the stringers in place. Before installation of each tread assembly, the tread assemblies may be adjusted to height as discussed above.

The first/lowest tread assembly may be installed (e.g., without balusters). This may help stabilize/align the stringers. Thereafter, the bottom plate assembly (306) may be installed as discussed above. The first pair of balusters may be assembled to the first tread assembly via the pins as discussed above. The safety bar may be installed to the first set of balusters via pins as discussed above. In alternative implementations, the first set of balusters and safety bar may be installed prior to installing the bottom plate assembly.

The second tread assembly may then be installed followed by installing the second set of balusters thereto. Thereafter, the safety bar may be removed from the first set of balusters and installed to the second set of balusters whereafter the next tread assembly may be installed and the process repeated. If the baluster inner and outer members are of the same length as the stringer inner and outer members, then once one has passed the region of overlap (which is seen by looking into the holes in the tops of the stringers to see whether there is two layers or one layer) one can switch over to using the widened top balusters). Once all the stair assembly and balusters have been installed, the handrails may be installed pinned or otherwise fastened to each associated baluster. Thereafter, the barricade may be unscrewed or otherwise removed.

Alternative variations may be used in situations where there is not need for one or both handrails or balusters (e.g., wherein there are walls on either side).

In an exemplary kit for forming the staircase 300, there are the two stringer assemblies including inner and outer members, feet, and pins (370 or other fasteners). There is also the top plate assembly and bottom plate assembly. There is also the two handrail assemblies including enough detent pins of the two respective sizes to address the maximal extension/height situation. An exemplary kit involves providing eighteen basic tread assemblies 350 plus ten pair of the regular balusters 360 and eight pair of the widened balusters 362. The kit further includes detent pins to secure all such balusters to their associated tread assemblies. The kit further includes the safety barrier 612 and bar 660 and associated pins (if different from pins used otherwise) and associated screws. Different sets of screws may be provided for screwing into different surfaces such as wood or concrete or one common type of screw fastener may be used for all. There may be spares of the pins, screws, and the like, a paper and/or digital media manual, and any other accessories. The various fasteners and manual may all be in a bag or other container. The system may be shipped in a carton or several associated cartons.

One or more embodiments of the present invention have been described. Nevertheless, it will be understood that various modifications may be made without departing from the spirit and scope of the invention. For example, particular regional building codes may influence particular implementations. Additionally, particular fields of use may influence particular configurations (e.g., use in the wood frame housing industry versus use in a more industrial setting). Accordingly, other embodiments are within the scope of the following claims.

What is claimed is:

1. A stair system (20; 300) for spanning between a lower floor (24) and an upper floor (26), the system comprising:

a first length-adjustable stringer (40A; 308A);

a second length-adjustable stringer (40B; 308B);

a plurality of tread assemblies (148; 350) installable to the first and second stringers and each having an adjustable pitch tread;

at least one handrail (268; 302A, 302B); and a plurality of balusters (280A, 280B; 360, 362) attached to or attachable to the tread assemblies and handrail and, via the tread assemblies to the first length-adjustable stringer and second-length adjustable stringer, wherein:

each tread assembly comprises:

a left portion (150A; 430A) for supporting the tread assembly on the left stringer;

a right portion (150B; 430B) for supporting the tread assembly on the right stringer;

said tread (180; 400) hingedly mounted relative to the left and right portions;

at least one adjuster (200, 210; 420, 452, 454) for adjusting the pitch of the tread relative to said left and right portions; and a riser (170; 402);

the stringers are telescoping stringers;

each stringer has a longitudinal array of first engagement features (120; 322); and each tread assembly has one or more left engagement features (160A-C; 450) and one or more right engagement features (160A-C; 450), the left and right engagement features mountable to the first engagement features of a respective left stringer of the first and second stringers and a respective right stringer of the first and second stringers.

2. The system of claim 1 wherein:

the riser is rigidly connected to the left portion and right portion and hinged relative to the tread.

3. The system of claim 2 wherein:

the left portion and the right portion each comprise a downwardly-open channel.

4. The system of claim 1 wherein each of the first and second stringers comprises:

an upper terminal portion and a lower terminal portion; and a lower end of the lower terminal portion bears a lower hinge and an upper end of the upper terminal portion bears an upper hinge.

5. The system of claim 4 wherein:

each lower hinge is positioned to allow alternative mounting to a horizontal surface of the lower floor or a vertical joist surface of the lower floor; and each upper hinge is positioned to allow mounting to a horizontal surface of the upper floor when the system is installed between the lower and upper floors.

6. The system of claim 1 further comprising a top mounting plate assembly and a bottom mounting plate assembly and wherein:

each of the first and second stringers comprises an upper terminal portion and a lower terminal portion; and a lower end of each lower terminal portion bears features for engaging a riser portion of the bottom plate assembly, the riser portion hinged relative to a base portion of the bottom mounting plate assembly; and an upper end of each upper terminal portion bears features for hanging the respective stringer from the top mounting plate assembly.

7. The system of claim 6 wherein:

the bottom mounting plate assembly base portion is positioned to allow alternative mounting to a horizontal surface of the lower floor or a vertical joist surface of the lower floor; and the features for hanging comprise transverse rods within the stringer upper terminal portion for engaging hooks of the top mounting plate assembly.

8. The system of claim 1 in an installed condition wherein:

the first and second stringers extend between the lower floor of a building and the upper floor of the building; and the plurality of tread assemblies are mounted to the stringers.

9. A method for installing the system of claim 1 between the lower floor and the upper floor of a building, the method comprising:

determining a length setting for the first and second stringers based upon a height of the upper floor above the lower floor;

adjusting the stringers to said length setting;

attaching the stringers to the upper floor and the lower floor; and attaching the tread assemblies to the stringers.

10. A method for installing a stair system (20; 300) for spanning between a lower floor (24) and an upper floor (26) of a building, the system comprising:

a first length-adjustable stringer (40A; 308A);

a second length-adjustable stringer (40B; 308B);

a plurality of tread assemblies (148; 350) installable to the first and second stringers and each having an adjustable pitch tread (180; 400);

at least one handrail (268; 302A, 302B); and a plurality of balusters (280A, 280B; 360, 362) attached to or attachable to the tread assemblies and handrail and, via the tread assemblies to the first length-adjustable stringer and second-length adjustable stringer, wherein:

the stringers are telescoping stringers;

each stringer has a longitudinal array of first engagement features (120; 322); and each tread assembly has one or more left engagement features (160A-C; 450) and one or more right engagement features (160A-C; 450), the left and right engagement features mountable to the first engagement features of a respective left stringer of the first and second stringers and a respective right stringer of the first and second stringers, the method comprising:

determining a length setting for the first and second stringers based upon a height of the upper floor above the lower floor;

adjusting the stringers to said length setting;

attaching the stringers to the upper floor and the lower floor; and attaching the tread assemblies to the stringers, wherein:

at least some of the tread assemblies are installed after the stringers are attached at least to one of the upper floor and lower floor; and the attaching of the at least some of the tread assemblies comprises: lowering the tread assemblies onto the stringers so that upper portions of the stringers are received in respective channels of the tread assemblies; and longitudinally shifting the tread assemblies so that the features shift to a locked condition wherein direct translatory removal of the tread assembly is resisted.

11. The method of claim 10 further comprising:

adjusting a pitch of at least some of the tread assemblies, the adjusting comprising relative rotation of respective left and right jack screws (200; 420) and nuts (210; 454).

12. The method of claim 11 further comprising:

removing the tread assemblies from the stringers;

removing the stringers from an installed location; and reinstalling the stringers and the tread assemblies at a new location.

13. A stair tread assembly (148; 350) for mounting to a first stringer and a second stringer, the tread assembly comprising:

a tread (180; 400);

a first baluster attached at a first side of the tread;

a second baluster attached at a second side of the tread;

means (150A, 150B, 160A-160C; 430A, 430B, 450) for removably and reinstallably mounting the tread to the first and second stringers; and means (200; 210; 420, 452, 454) for adjusting a pitch of the tread, wherein:

the means for removably and reinstallably remounting the tread to the first and second stringers comprises first and second downwardly-open channels for respectively receiving the first and second stringers; and the first baluster is mounted to the first downwardly-open channel and the second baluster is mounted to the second downwardly-open channel.

14. The assembly of claim 13 wherein:

the means for adjusting a pitch of the tread comprises respective left and right jack screws (200; 420) and nuts (210; 454).

15. The assembly of claim 13 wherein:

the first baluster has an elongate cross-section; and the second baluster has an elongate cross-section.

16. A method for assembling a stair system comprising sequentially installing a plurality of said stair tread assemblies (148; 350) of claim 13 to first and second stringers, wherein in each of the tread assemblies: the means for removably and reinstallably remounting the tread to the first and second stringers comprises:

one or more first engagement features for engaging the first stringer; and one or more second engagement features for engaging the second stringer, the method comprising each of the tread assemblies being installed as a unit by:

an insertion generally normal to a longitudinal direction of the stringers; and a locking translation generally parallel to said longitudinal direction.

17. The method of claim 16 wherein:

the tread assemblies are sequentially installed from the bottom up.

18. A stair system (20; 300) for spanning between a lower floor (24) and an upper floor (26), the system comprising:

a first length-adjustable stringer (40A; 308A);

a second length-adjustable stringer (40B; 308B);

a plurality of tread assemblies (148; 350) installable to the first and second stringers and each having an adjustable pitch tread (180; 400);

at least one handrail (268; 302A, 302B); and a plurality of balusters (280A, 280B; 360, 362) attached to or attachable to the tread assemblies and handrail and, via the tread assemblies to the first length-adjustable stringer and second-length adjustable stringer, wherein:

the stringers are telescoping stringers;

each stringer comprises:

a longitudinal array of first engagement features (120; 322);

an upper terminal portion and a lower terminal portion; and a lower end of the lower terminal portion bears a lower hinge and an upper end of the upper terminal portion bears an upper hinge;

each lower hinge is positioned to allow alternative mounting to a horizontal surface of the lower floor or a vertical joist surface of the lower floor;

each upper hinge is positioned to allow mounting to a horizontal surface of the upper floor when the system is installed between the lower and upper floors; and each tread assembly has one or more left engagement features (160A-C; 450) and one or more right engagement features (160A-C; 450), the left and right engagement features mountable to the first engagement features of a respective left stringer of the first and second stringers and a respective right stringer of the first and second stringers.

19. A stair system (20; 300) for spanning between a lower floor (24) and an upper floor (26), the system comprising:

a first length-adjustable stringer (40A; 308A);

a second length-adjustable stringer (40B; 308B);

a top mounting plate assembly and a bottom mounting plate assembly;

a plurality of tread assemblies (148; 350) installable to the first and second stringers and each having an adjustable pitch tread (180; 400);

at least one handrail (268; 302A, 302B); and a plurality of balusters (280A, 280B; 360, 362) attached to or attachable to the tread assemblies and handrail and, via the tread assemblies to the first length-adjustable stringer and second-length adjustable stringer, wherein:

the stringers are telescoping stringers;

each stringer has a longitudinal array of first engagement features (120; 322);

each tread assembly has one or more left engagement features (160A-C; 450) and one or more right engagement features (160A-C; 450), the left and right engagement features mountable to the first engagement features of a respective left stringer of the first and second stringers and a respective right stringer of the first and second stringers;

each of the first and second stringers comprises an upper terminal portion and a lower terminal portion; and a lower end of each lower terminal portion bears features for engaging a riser portion of the bottom plate assembly, the riser portion hinged relative to a base portion of the bottom mounting plate assembly; and an upper end of each upper terminal portion bears features for hanging the respective stringer from the top mounting plate assembly.

20. The system of claim 19 wherein:

the bottom mounting plate assembly base portion is positioned to allow alternative mounting to a horizontal surface of the lower floor or a vertical joist surface of the lower floor; and the features for hanging comprise transverse rods within the stringer upper terminal portions for engaging hooks of the top mounting plate assembly.

* * * * *